US010427008B2

(12) United States Patent
Sullivan et al.

(10) Patent No.: US 10,427,008 B2
(45) Date of Patent: Oct. 1, 2019

(54) MULTI-LAYER CORE GOLF BALL INCORPORATING INTERMEDIATE COMPOSITE LAYER COMPRISED OF FUNCTIONALIZED NANOSTRUCTURES

(71) Applicant: Acushnet Company, Fairhaven, MA (US)

(72) Inventors: Michael J. Sullivan, Old Lyme, CT (US); Mark L. Binette, Mattapoisett, MA (US); Brian Comeau, Berkley, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/219,998

(22) Filed: Dec. 14, 2018

(65) Prior Publication Data

US 2019/0118042 A1 Apr. 25, 2019

Related U.S. Application Data

(60) Continuation-in-part of application No. 16/029,860, filed on Jul. 9, 2018, now Pat. No. 10,328,313, which is a continuation of application No. 15/697,733, filed on Sep. 7, 2017, now Pat. No. 10,016,658, which is a continuation of application No. 15/071,280, filed on (Continued)

(51) Int. Cl.
*A63B 37/06* (2006.01)
*A63B 37/00* (2006.01)

(52) U.S. Cl.
CPC ..... *A63B 37/0076* (2013.01); *A63B 37/0003* (2013.01); *A63B 37/0031* (2013.01); *A63B 37/0033* (2013.01); *A63B 37/0039* (2013.01); *A63B 37/0043* (2013.01); *A63B 37/0045* (2013.01); *A63B 37/0062* (2013.01); *A63B 37/0063* (2013.01); *A63B 37/0064* (2013.01); *A63B 37/0092* (2013.01);

(Continued)

(58) Field of Classification Search
CPC ..... A63B 37/0076
USPC ..... 473/376
See application file for complete search history.

(56) References Cited

U.S. PATENT DOCUMENTS 2,998,977 A 9/1961 Molitor
4,650,193 A 3/1987 Molitor et al.

(Continued)

OTHER PUBLICATIONS

ASP; Journal of Nanoscience and Nanotechnology; vol. 10, 1-4, 2010; Formation and Stability of Hollow MgO Nanoshells; Gopi Krishnan, G. Palasantzas, and J Kooi.

*Primary Examiner* — Raeann Gorden
(74) *Attorney, Agent, or Firm* — Margaret C. Barker

(57) ABSTRACT

Golf balls comprising a multi-layer core and a cover are disclosed. The multi-layer core comprises at least one intermediate core layer formed from a composite composition comprising functionalized nano-structures. The functionalized nano-structures may be selected from the group consisting of functionalized polymer nano-structures, functionalized metallic nano-structures, and functionalized elemental nano-structures. For example, the functionalized nano-structures may comprise functionalized graphene, functionalized carbon nanotube, and/or functionalized polyamide nano-fiber. The functionalized nano-structures may be mixed/blended or otherwise combined with conductive nanoshelled structures in the composite composition.

19 Claims, 1 Drawing Sheet

Related U.S. Application Data

Mar. 16, 2016, now Pat. No. 9,764,197, which is a continuation of application No. 14/058,374, filed on Oct. 21, 2013, now Pat. No. 9,289,652, which is a division of application No. 12/629,549, filed on Dec. 2, 2009, now Pat. No. 8,562,460, which is a continuation-in-part of application No. 12/407,856, filed on Mar. 20, 2009, now Pat. No. 7,708,656, which is a continuation-in-part of application No. 11/972,240, filed on Jan. 10, 2008, now Pat. No. 7,722,482, application No. 16/219,998, which is a continuation-in-part of application No. 15/687,617, filed on Aug. 28, 2017.

(52) U.S. Cl.
CPC ..... *A63B 37/0035* (2013.01); *A63B 37/0047* (2013.01); *A63B 37/0066* (2013.01)

(56) References Cited

U.S. PATENT DOCUMENTS 4,781,383 A 11/1988 Kamada et al.
4,858,924 A 8/1989 Saito et al.
5,002,281 A 3/1991 Nakahara et al.
5,033,748 A 7/1991 Ebisuno
5,048,838 A 9/1991 Chikaraishi et al.
5,104,126 A 4/1992 Gentiluomo
5,314,187 A 5/1994 Proudfit
5,482,285 A 1/1996 Yabuki et al.
5,490,674 A 2/1996 Hamada et al.
5,733,206 A 3/1998 Nesbitt et al.
5,743,816 A 4/1998 Ohsumi et al.
5,772,531 A 6/1998 Ohsumi et al.
5,779,562 A 7/1998 Melvin et al.
5,929,189 A * 7/1999 Ichikawa ..... A63B 37/0003 473/371
5,976,443 A 11/1999 Nesbitt et al.
6,004,225 A 12/1999 Owens et al.
6,057,403 A 5/2000 Sullivan et al.
6,071,201 A 6/2000 Maruko
6,113,831 A 9/2000 Nesbitt et al.
6,142,887 A 11/2000 Sullivan et al.
6,213,895 B1 4/2001 Sullivan et al.
6,231,461 B1 * 5/2001 Moriyama ..... A63B 37/0003 473/376
6,245,859 B1 6/2001 Sullivan et al.
6,277,034 B1 8/2001 Nesbitt et al.
6,290,612 B1 9/2001 Maruko et al.
6,336,872 B1 1/2002 Moriyama et al.
6,379,269 B1 4/2002 Nesbitt et al.
6,394,912 B1 5/2002 Nakamura et al.
6,406,383 B2 6/2002 Moriyama et al.
6,431,998 B1 8/2002 Nakamura et al.
6,432,342 B1 8/2002 Nesbitt et al.
6,494,795 B2 12/2002 Sullivan
6,500,076 B1 12/2002 Morgan et al.
6,569,036 B1 5/2003 Takemura et al.
6,605,009 B1 8/2003 Nakamura et al.
6,616,550 B2 9/2003 Nesbitt et al.
6,626,770 B2 9/2003 Takemura et al.
6,629,898 B2 10/2003 Nardacci
6,688,991 B2 2/2004 Sullivan et al.
6,710,114 B2 3/2004 Bissonnette et al.
6,793,592 B2 9/2004 Sullivan et al.
6,794,429 B2 9/2004 Lacy
6,802,784 B2 10/2004 Sullivan et al.
6,815,521 B2 11/2004 Iwami
6,852,044 B2 2/2005 Sullivan et al.
6,852,252 B2 2/2005 Halas et al.
6,855,074 B2 2/2005 Kato
6,899,642 B2 5/2005 Morgan et al.
6,913,548 B2 7/2005 Moriyama et al.
6,916,254 B2 7/2005 Ladd et al.
6,919,395 B2 7/2005 Rajagopalan et al.
6,981,926 B2 1/2006 Sullivan et al.
6,988,962 B2 1/2006 Sullivan et al.
7,037,965 B2 5/2006 Sullivan et al.
7,074,137 B2 7/2006 Sullivan et al.
7,125,345 B2 10/2006 Sullivan et al.
7,153,467 B2 12/2006 Brum et al.
7,238,122 B2 7/2007 Harris et al.
7,255,656 B2 8/2007 Sullivan et al.
7,259,191 B2 8/2007 Sullivan et al.
7,377,863 B2 5/2008 Sullivan et al.
7,452,291 B2 11/2008 Sullivan et al.
7,572,855 B2 8/2009 Fudemoto et al.
7,723,100 B2 5/2010 Natan et al.
7,790,066 B2 9/2010 Wang et al.
7,891,310 B2 2/2011 Taylor et al.
8,217,143 B2 7/2012 Kim et al.
8,337,331 B2 12/2012 Bulpett et al.
8,530,613 B2 9/2013 Jang et al.
8,758,167 B2 6/2014 Morgan et al.
8,918,161 B2 12/2014 Natan et al.
8,986,515 B2 3/2015 Zhamu et al.
9,076,570 B2 7/2015 Raffaelle et al.
9,096,925 B2 8/2015 Kim et al.
9,267,889 B1 2/2016 Klopfer et al.
9,591,979 B2 3/2017 Taranekar et al.
9,597,677 B2 3/2017 Campidelli et al.
9,730,491 B2 8/2017 Hsieh et al.
9,789,366 B1 10/2017 Chavan et al.
9,814,786 B2 11/2017 Bovin et al.
2006/0073914 A1 4/2006 Sullivan et al.
2006/0128904 A1 6/2006 Sullivan et al.
2007/0155542 A1 7/2007 Sullivan et al.
2007/0191526 A1 8/2007 Jordan et al.
2009/0181799 A1 7/2009 Sullivan et al.
2009/0181800 A1 7/2009 Sullivan et al.
2009/0181804 A1 7/2009 Sullivan et al.
2009/0197702 A1 8/2009 Sullivan et al.
2009/0197703 A1 8/2009 Sullivan et al.
2009/0197705 A1 8/2009 Sullivan et al.

* cited by examiner

MULTI-LAYER CORE GOLF BALL INCORPORATING INTERMEDIATE COMPOSITE LAYER COMPRISED OF FUNCTIONALIZED NANOSTRUCTURES

CROSS-REFERENCE TO RELATED APPLICATIONS

This application is a continuation-in-part of co-pending U.S. patent application Ser. No. 16/029,860, filed Jul. 9, 2018, which is a continuation of U.S. patent application Ser. No. 15/697,733, filed Sep. 7, 2017, now U.S. Pat. No. 10,016,658, which is a continuation of U.S. patent application Ser. No. 15/071,280, filed Mar. 16, 2016, now U.S. Pat. No. 9,764,197, which is a continuation of U.S. patent application Ser. No. 14/058,374, filed Oct. 21, 2013, now U.S. Pat. No. 9,289,652, which is a division of U.S. patent application Ser. No. 12/629,549, filed Dec. 2, 2009, now U.S. Pat. No. 8,562,460, which is a continuation-in-part of Ser. No. 12/407,856, filed Mar. 20, 2009, now U.S. Pat. No. 7,708,656, which is a continuation-in-part of U.S. patent application Ser. No. 11/972,240, filed Jan. 10, 2008, now U.S. Pat. No. 7,722,482, the entire disclosures of which are hereby incorporated herein by reference.

This application is also a continuation-in-part of co-pending U.S. patent application Ser. No. 15/687,617, filed Aug. 28, 2017, the entire disclosure of which is hereby incorporated herein by reference.

FIELD OF THE INVENTION

The present invention generally relates to golf balls, and more particularly to golf balls incorporating at least one intermediate nanostructured composite layer.

BACKGROUND OF THE INVENTION

Golf balls having multi-layer cores are known. For example, U.S. Pat. No. 6,852,044 discloses golf balls having multi-layered cores having a relatively soft, low compression inner core surrounded by a relatively rigid outer core. U.S. Pat. No. 5,772,531 discloses a solid golf ball comprising a solid core having a three-layered structure composed of an inner layer, an intermediate layer, and an outer layer, and a cover for coating the solid core. U.S. Patent Application Publication No. 2006/0128904 also discloses multi-layer core golf balls. Other examples of multi-layer cores can be found, for example, in U.S. Pat. Nos. 5,743,816, 6,071,201, 6,336,872, 6,379,269, 6,394,912, 6,406,383, 6,431,998, 6,569,036, 6,605,009, 6,626,770, 6,815,521, 6,855,074, 6,913,548, 6,981,926, 6,988,962, 7,074,137, 7,153,467 and 7,255,656.

The present invention provides a novel multi-layer core golf ball construction which includes an intermediate layer, such as an intermediate core layer, that is formed from a composite composition comprising functionalized nano-structures.

SUMMARY OF THE INVENTION

In one embodiment, a golf ball of the invention includes a multi-layer core comprising an intermediate core layer that is formed from a composite composition comprising functionalized nanostructures. In one such embodiment, the present invention is directed to a golf ball comprising an inner core, an intermediate core layer, an outer core layer, and a cover layer. The inner core comprises a center formed from a first thermoset composition, and has a diameter of from 0.500 inches to 1.580 inches, a center hardness of from 40 Shore C to 70 Shore C, and a surface hardness of from 50 Shore C to 95 Shore C. The intermediate core layer has a thickness of from 0.010 inches to 0.070 inches, an outer surface hardness of from 65 Shore D to 95 Shore D, and is formed from a composite composition comprising functionalized nano-structures. The outer core layer has a thickness of from 0.0010 inches to 0.075 inches, an outer surface hardness of from 45 Shore C to 90 Shore C, and is formed from a second thermoset composition. The cover layer has a thickness of from 0.010 inches to 0.050 inches and is formed from a composition having a material hardness of from 30 Shore D to 65 Shore D.

The nano-structures may be selected from the group consisting of nanoflakes, nanofibers, nanofillers, nanotubes, nanoparticles, nanocages, and combinations thereof. The functionalized nano-structures may be selected from the group consisting of functionalized polymer nano-structures, functionalized metallic nano-structures, and functionalized elemental nano-structures. The functionalized nano-structures may comprise functionalized graphene, functionalized carbon nanotube, and/or functionalized polyamide nanofiber.

The functionalized nano-structures may be mixed or otherwise combined with conductive nanoshelled structures.

The conductive nanoshelled structures may comprise zinc oxide nanoshells, magnesium oxide nanoshells, or combinations thereof. The conductive nanoshelled structures may have surface cations selected from the group consisting of zinc, sodium, magnesium, lithium, potassium, and combinations thereof. The functionalized nano-structures and conductive nanoshelled structures are included in the composite composition in a ratio of 98:2 to 50:50.

In yet another embodiment, the present invention is directed to a golf ball comprising an inner core, an intermediate core layer, an outer core layer, a first thermoplastic layer disposed between the inner core and the intermediate core layer, and a second thermoplastic core layer disposed between intermediate core layer and the outer core layer. The inner core comprises a center formed from a first thermoset composition and has a diameter of from 1.000 inches to 1.580 inches, a center hardness of from 40 Shore C to 70 Shore C, and a surface hardness of from 50 Shore C to 95 Shore C. The intermediate core layer has a thickness of from 0.0010 inches to 0.070 inches and an outer surface hardness of from 65 Shore D to 95 Shore D, and formed from a composite composition comprising functionalized nano-structures. The outer core layer is formed from a second thermoset composition and, has a thickness of from 0.010 inches to 0.075 inches, and has an outer surface hardness of from 45 Shore C to 90 Shore C. The cover layer has a thickness of from 0.010 inches to 0.050 inches and is formed from a composition having a material hardness of from 30 Shore D to 65 Shore D.

DETAILED DESCRIPTION

Advantageously, the multi-layer core golf ball of the invention includes an intermediate layer, such as an intermediate core layer, that is formed from a composite composition comprising functionalized nanostructures.

Beneficially, a layer of composite composition comprising functionalized nanostructures may be very thin such as from about 0.001 to about 0.010 inches, or thicker such as up to about 0.075 inches. Thus, an intermediate layer of composite composition comprising functionalized nanostructures may be a molded layer, be applied as a spray, or comprise a dipping solution in a solvent (which is typically removed before application of an adjacent external layer).

Functionalized nano-structures may include for example functionalized nanoflakes, nanofibers, nanofillers, nanotubes, nanoparticles, nanocages, and combinations thereof. The functionalized nano-structures may be selected from the group consisting of functionalized polymer nano-structures, functionalized metallic nano-structures, and functionalized elemental nano-structures.

The functionalized nano-structures comprise functionalized graphene, functionalized carbon nanotube, and/or functionalized polyamide nano-fiber.

Without being bound to a particular theory, interactions between the functionalized nano-structures and the matrix of polymer composition into which it is incorporated create excellent compatibility there between, improving durability and strength of the composite composition without sacrificing the elasticity/elongation properties that are necessary and sufficient to withstand the great force and impact of a club face striking the golf ball.

The composite composition comprising functionalized nanostructures may comprise any polymeric, metallic or elemental material including but not limited to graphite, graphene or other carbon rich material.

Figure 1:
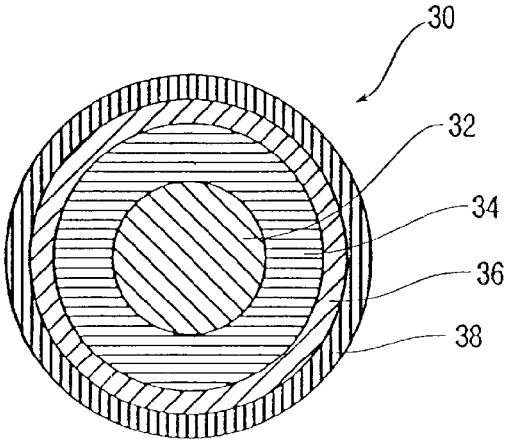
FIG. 1 is a cross-sectional view of a golf ball according to one embodiment of the present invention.

A golf ball having a multi-layer core and a cover enclosing the core is disclosed. FIG. 1 shows a golf ball 30 according to one embodiment of the present invention, including an inner core 32, an intermediate core 34, an outer core 36, and a cover 38. While shown in FIG. 1 as single layers, any one or more of inner core 32, intermediate core 34, outer core 36, and cover 38 may consist of one, two, or multiple layers.

In a particular embodiment, each one of inner core 32, intermediate core 34, outer core 36, and cover 38 is a single layer.

Figure 2:
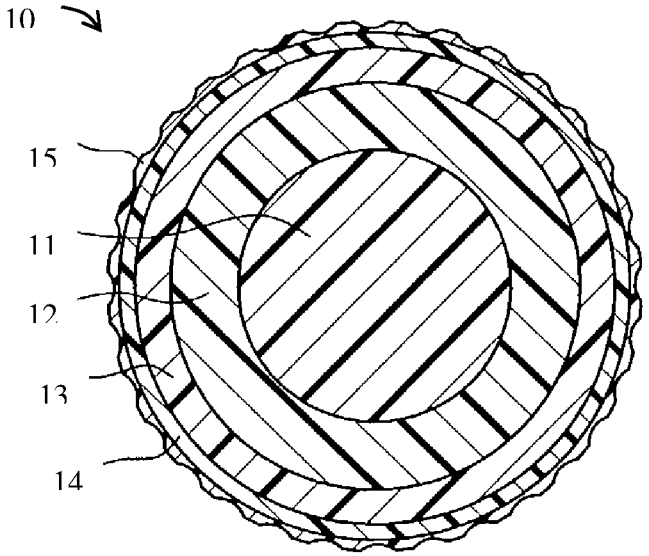
FIG. 2 is a cross-sectional view of a golf ball core according to another embodiment of the present invention.

In another particular embodiment, inner core 32 consists of two layers, and each one of intermediate core 34, outer core 36, and cover 38 is a single layer. FIG. 2 shows a golf ball 10 according to an embodiment of the present invention, including a center 11, an additional inner core layer 12, an intermediate core layer 13, an outer core layer 14, and a cover layer 15.

In another particular embodiment, cover 38 consists of two layers, and each one of inner core 32, intermediate core 34, and outer core 36 is a single layer.

In yet another particular embodiment, inner core 32 and cover 38 each consists of two layer, and each one of intermediate core 34 and outer core 36 is a single layer.

Multi-layer cores of the present invention comprise an inner core, an intermediate core, and an outer core. The overall diameter of the multi-layer core, also referred to herein as the outside diameter of the outer core layer, is within a range having a lower limit of 1.000 or 1.300 or 1.400 or 1.500 or 1.580 or 1.600 or 1.610 or 1.620 inches and an upper limit of 1.600 or 1.610 or 1.620 or 1.630 or 1.640 or 1.650 or 1.660 inches, wherein the upper limit is greater than the lower limit (e.g., when the lower limit is 1.610 inches, the upper limit is 1.620, 1.630, 1.640, 1.650, or 1.660 inches). In a particular embodiment, the multi-layer core has an overall diameter of 1.450 inches or 1.500 inches or 1.510 inches or 1.530 inches or 1.550 inches or 1.570 inches or 1.580 inches or 1.590 inches or 1.600 inches or 1.610 inches or 1.620 inches.

The inner core consists of a single inner core layer, also referred to herein as a center; or a center and an additional inner core layer; or a center and two or more additional inner core layers. The inner core has an overall diameter of 0.500 inches or greater, or 1.000 inches or greater, or 1.250 inches or greater, or 1.300 inches or greater, or 1.350 inches or greater, or 1.390 inches or greater, or 1.400 inches or greater, or 1.425 inches or greater, or 1.450 inches or greater, or an overall diameter within a range having a lower limit of 0.250 or 0.500 or 0.750 or 1.000 or 1.250 or 1.300 or 1.325 or 1.350 or 1.390 or 1.400 or 1.440 or 1.450 inches and an upper limit of 1.450 or 1.460 or 1.475 or 1.490 or 1.500 or 1.520 or 1.550 or 1.580 or 1.600 inches.

The inner core has a center hardness within a range having a lower limit of 20 or 25 or 30 or 35 or 40 or 45 or 50 or 55 Shore C and an upper limit of 60 or 65 or 70 or 75 or 90 Shore C. The inner core has an outer surface hardness within a range having a lower limit of 20 or 50 or 70 or 75 Shore C and an upper limit of 75 or 80 or 85 or 90 or 95 Shore C. The inner core has a negative hardness gradient, a zero hardness gradient, or a positive hardness gradient of up to 45 Shore C, or a positive hardness gradient of from 10 Shore C to 45 Shore C. In a particular embodiment, the inner core consists of a center formed from a zero gradient formulation as disclosed, for example, in U.S. Pat. Nos. 7,537,530 and 7,537,529, the entire disclosures of which are hereby incorporated herein by reference. The inner core has an overall compression of 90 or less, or 80 or less, or 70 or less, or 60 or less, or 50 or less, or 40 or less, or 20 or less, or a compression within a range having a lower limit of 10 or 20 or 30 or 35 or 40 or 50 or 60 and an upper limit of 40 or 50 or 60 or 70 or 80 or 90, wherein the upper limit is greater than the lower limit (e.g., when the lower limit is 50, the upper limit is 60, 70, 80 or 90).

Each of the inner core layer(s) is formed from a thermoset or thermoplastic polymer composition. In a particular embodiment, the inner core consists of a center formed from a thermoset composition. In another particular embodiment, the inner core consists of a center formed from a thermoplastic polymer composition. In another particular embodiment, the inner core consists of a center and an additional inner core layer, each of which is formed from the same or different thermoset compositions. In another particular embodiment, the inner core consists of a center and an additional inner core layer, each of which is formed from the same or different thermoplastic polymer compositions. In another particular embodiment, the inner core consists of a center and an additional inner core layer, wherein either the center or the additional inner core layer is formed from a thermoset composition and the other of the center or the additional inner core layer is formed from a thermoplastic polymer composition. In yet another particular embodiment, the inner core consists of a center, a first additional inner core layer, and a second additional inner core layer, wherein each of the inner core layer compositions is the same or different than the other inner core layer compositions.

Suitable thermoset compositions for forming the inner core layer(s) include rubber compositions comprising a base rubber, an initiator agent, a coagent, and optionally one or more of a zinc oxide, zinc stearate or stearic acid, antioxidant, and soft and fast agent. Suitable base rubbers include natural and synthetic rubbers including, but not limited to, polybutadiene, polyisoprene, ethylene propylene rubber ("EPR"), styrene-butadiene rubber, styrenic block copolymer rubbers (such as SI, SIS, SB, SBS, SIBS, and the like, where "S" is styrene, "I" is isoprene, and "B" is butadiene), butyl rubber, halobutyl rubber, polystyrene elastomers, polyethylene elastomers, polyurethane elastomers, polyurea elastomers, metallocene-catalyzed elastomers and plastomers, copolymers of isobutylene and para-alkylstyrene, halogenated copolymers of isobutylene and para-alkylstyrene, copolymers of butadiene with acrylonitrile, polychloroprene, alkyl acrylate rubber, chlorinated isoprene rubber, acrylonitrile chlorinated isoprene rubber, and combinations of two or more thereof (e.g., polybutadiene combined with lesser amounts of other thermoset materials selected from cis-polyisoprene, trans-polyisoprene, balata, polychloroprene, polynorbornene, polyoctenamer, polypentenamer, butyl rubber, EPR, EPDM, styrene-butadiene, and similar thermoset materials). Diene rubbers are preferred, particularly polybutadiene (including 1,4-polybutadiene having a cis-structure of at least 40%), styrene-butadiene, and mixtures of polybutadiene with other elastomers wherein the amount of polybutadiene present is at least 40 wt % based on the total polymeric weight of the mixture. Particularly preferred polybutadienes include high-cis neodymium-catalyzed polybutadienes and cobalt-, nickel-, or lithium-catalyzed polybutadienes. Suitable examples of commercially available polybutadienes include, but are not limited to, Buna CB high-cis neodymium-catalyzed polybutadiene rubbers, such as Buna CB 23, and Taktene® high-cis cobalt-catalyzed polybutadiene rubbers, such as Taktene® 220 and 221, commercially available from LANXESS® Corporation; SE BR-1220, commercially available from The Dow Chemical Company; Europrene® NEOCIS® BR 40 and BR 60, commercially available from Polimeri Europa®; UBE-POL-BR® rubbers, commercially available from UBE Industries, Inc.; BR 01, commercially available from Japan Synthetic Rubber Co., Ltd.; and Neodene high-cis neodymium-catalyzed polybutadiene rubbers, such as Neodene BR 40, commercially available from Karbochem.

Suitable initiator agents include organic peroxides, high energy radiation sources capable of generating free radicals, and combinations thereof. High energy radiation sources capable of generating free radicals include, but are not limited to, electron beams, ultra-violet radiation, gamma radiation, X-ray radiation, infrared radiation, heat, and combinations thereof. Suitable organic peroxides include, but are not limited to, dicumyl peroxide; n-butyl-4,4-di(t-butylperoxy) valerate; 1,1-di(t-butylperoxy)3,3,5-trimethylcyclohexane; 2,5-dimethyl-2,5-di(t-butylperoxy) hexane; di-t-butyl peroxide; di-t-amyl peroxide; t-butyl peroxide; t-butyl cumyl peroxide; 2,5-dimethyl-2,5-di(t-butylperoxy)hexyne-3; di(2-t-butyl-peroxyisopropyl)benzene; dilauroyl peroxide; dibenzoyl peroxide; t-butyl hydroperoxide; lauryl peroxide; benzoyl peroxide; and combinations thereof. Examples of suitable commercially available peroxides include, but are not limited to Perkadox® BC dicumyl peroxide, commercially available from Akzo Nobel, and Varox® peroxides, such as Varox® ANS benzoyl peroxide, Varox® 231 1,1-di(t-butylperoxy)3,3,5-trimethylcyclohexane, and Varox® 230-XL n-butyl-4,4-bis(tert-butylperoxy)valerate, commercially available from RT Vanderbilt Company, Inc. Peroxide initiator agents are generally present in the rubber composition in an amount of at least 0.05 parts by weight per 100 parts of the base rubber, or an amount within the range having a lower limit of 0.05 parts or 0.1 parts or 0.8 parts or 1 part or 1.25 parts or 1.5 parts by weight per 100 parts of the base rubber, and an upper limit of 2.5 parts or 3 parts or 5 parts or 6 parts or 10 parts or 15 parts by weight per 100 parts of the base rubber.

Coagents are commonly used with peroxides to increase the state of cure. Suitable coagents include, but are not limited to, metal salts of unsaturated carboxylic acids; unsaturated vinyl compounds and polyfunctional monomers (e.g., trimethylolpropane trimethacrylate); phenylene bismaleimide; and combinations thereof. Particular examples of suitable metal salts include, but are not limited to, one or more metal salts of acrylates, diacrylates, methacrylates, and dimethacrylates, wherein the metal is selected from magnesium, calcium, zinc, aluminum, lithium, nickel, and sodium. In a particular embodiment, the coagent is selected from zinc salts of acrylates, diacrylates, methacrylates, dimethacrylates, and mixtures thereof. In another particular embodiment, the coagent is zinc diacrylate. When the coagent is zinc diacrylate and/or zinc dimethacrylate, the coagent is typically included in the rubber composition in an amount within the range having a lower limit of 1 or 5 or 10 or 15 or 19 or 20 parts by weight per 100 parts of the base rubber, and an upper limit of 24 or 25 or 30 or 35 or 40 or 45 or 50 or 60 parts by weight per 100 parts of the base rubber. When one or more less active coagents are used, such as zinc monomethacrylate and various liquid acrylates and methacrylates, the amount of less active coagent used may be the same as or higher than for zinc diacrylate and zinc dimethacrylate coagents. The desired compression may be obtained by adjusting the amount of crosslinking, which can be achieved, for example, by altering the type and amount of coagent.

The rubber composition optionally includes a curing agent. Suitable curing agents include, but are not limited to, sulfur; N-oxydiethylene 2-benzothiazole sulfenamide; N,N-di-ortho-tolylguanidine; bismuth dimethyldithiocarbamate; N-cyclohexyl 2-benzothiazole sulfenamide; N,N-diphenylguanidine; 4-morpholinyl-2-benzothiazole disulfide; dipentamethylenethiuram hexasulfide; thiuram disulfides; mercaptobenzothiazoles; sulfenamides; dithiocarbamates; thiuram sulfides; guanidines; thioureas; xanthates; dithiophosphates; aldehyde-amines; dibenzothiazyl disulfide; tetraethylthiuram disulfide; tetrabutylthiuram disulfide; and combinations thereof.

The rubber composition optionally contains one or more antioxidants. Antioxidants are compounds that can inhibit or prevent the oxidative degradation of the rubber. Some antioxidants also act as free radical scavengers; thus, when antioxidants are included in the rubber composition, the amount of initiator agent used may be as high or higher than the amounts disclosed herein. Suitable antioxidants include, for example, dihydroquinoline antioxidants, amine type antioxidants, and phenolic type antioxidants.

The rubber composition may also contain one or more fillers to adjust the density and/or specific gravity of the core. Exemplary fillers include precipitated hydrated silica, clay, talc, asbestos, glass fibers, aramid fibers, mica, calcium metasilicate, zinc sulfate, barium sulfate, zinc sulfide, lithopone, silicates, silicon carbide, diatomaceous earth, polyvinyl chloride, carbonates (e.g., calcium carbonate, zinc carbonate, barium carbonate, and magnesium carbonate), metals (e.g., titanium, tungsten, aluminum, bismuth, nickel, molybdenum, iron, lead, copper, boron, cobalt, beryllium, zinc, and tin), metal alloys (e.g., steel, brass, bronze, boron carbide whiskers, and tungsten carbide whiskers), metal oxides (e.g., zinc oxide, tin oxide, iron oxide, calcium oxide, aluminum oxide, titanium dioxide, magnesium oxide, and zirconium oxide), particulate carbonaceous materials (e.g., graphite, carbon black, cotton flock, natural bitumen, cellulose flock, and leather fiber), microballoons (e.g., glass and ceramic), fly ash, regrind (i.e., core material that is ground and recycled), nanofillers, and combinations of two or more thereof. The amount of particulate material(s) present in the rubber composition is typically within a range having a lower limit of 5 parts or 10 parts by weight per 100 parts of the base rubber, and an upper limit of 30 parts or 50 parts or 100 parts by weight per 100 parts of the base rubber. Filler materials may be dual-functional fillers, such as zinc oxide (which may be used as a filler/acid scavenger) and titanium dioxide (which may be used as a filler/brightener material).

The rubber composition may also contain one or more additives selected from processing aids, processing oils, plasticizers, coloring agents, fluorescent agents, chemical blowing and foaming agents, defoaming agents, stabilizers, softening agents, impact modifiers, free radical scavengers, accelerators, scorch retarders, and the like. The amount of additive(s) typically present in the rubber composition is typically within a range having a lower limit of 0 parts by weight per 100 parts of the base rubber, and an upper limit of 20 parts or 50 parts or 100 parts or 150 parts by weight per 100 parts of the base rubber.

The rubber composition optionally includes a soft and fast agent. Preferably, the rubber composition contains from 0.05 phr to 10.00 phr of a soft and fast agent. In one embodiment, the soft and fast agent is present in an amount within a range having a lower limit of 0.05 or 0.10 or 0.20 or 0.50 phr and an upper limit of 1.00 or 2.00 or 3.00 or 5.00 phr. In another embodiment, the soft and fast agent is present in an amount within a range having a lower limit of 2.00 or 2.35 phr and an upper limit of 3.00 or 4.00 or 5.00 phr. In an alternative high concentration embodiment, the soft and fast agent is present in an amount within a range having a lower limit of 5.00 or 6.00 or 7.00 phr and an upper limit of 8.00 or 9.00 or 10.00 phr. In another embodiment, the soft and fast agent is present in an amount of 2.6 phr.

Suitable soft and fast agents include, but are not limited to, organosulfur and metal-containing organosulfur compounds; organic sulfur compounds, including mono, di, and polysulfides, thiol, and mercapto compounds; inorganic sulfide compounds; blends of an organosulfur compound and an inorganic sulfide compound; Group VIA compounds; substituted and unsubstituted aromatic organic compounds that do not contain sulfur or metal; aromatic organometallic compounds; hydroquinones; benzoquinones; quinhydrones; catechols; resorcinols; and combinations thereof.

As used herein, "organosulfur compound" refers to any compound containing carbon, hydrogen, and sulfur, where the sulfur is directly bonded to at least 1 carbon. As used herein, the term "sulfur compound" means a compound that is elemental sulfur, polymeric sulfur, or a combination thereof. It should be further understood that the term "elemental sulfur" refers to the ring structure of $S_8$ and that "polymeric sulfur" is a structure including at least one additional sulfur relative to elemental sulfur.

Particularly suitable as soft and fast agents are organosulfur compounds having the following general formula:

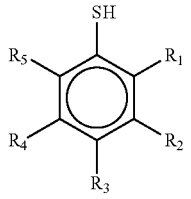

where $R_1$-$R_5$ can be $C_1$-$C_8$ alkyl groups; halogen groups; thiol groups (—SH), carboxylated groups; sulfonated groups; and hydrogen; in any order; and also pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol and; zinc salts thereof; non-metal salts thereof, for example, ammonium salt of pentachlorothiophenol; magnesium pentachlorothiophenol; cobalt pentachlorothiophenol; and combinations thereof. Preferably, the halogenated thiophenol compound is pentachlorothiophenol, which is commercially available in neat form or under the tradename STRUKTOL® A95, a clay-based carrier containing the sulfur compound pentachlorothiophenol loaded at 45 percent. STRUKTOL® A95 is commercially available from Struktol Company of America of Stow, Ohio. PCTP is commercially available in neat form from eChinachem of San Francisco, Calif. and in the salt form from eChinachem of San Francisco, Calif. Most preferably, the halogenated thiophenol compound is the zinc salt of pentachlorothiophenol, which is commercially available from eChinachem of San Francisco, Calif. Suitable organosulfur compounds are further disclosed, for example, in U.S. Pat. Nos. 6,635,716, 6,919,393, 7,005,479 and 7,148,279, the entire disclosures of which are hereby incorporated herein by reference.

Suitable metal-containing organosulfur compounds include, but are not limited to, cadmium, copper, lead, and tellurium analogs of diethyldithiocarbamate, diamyldithiocarbamate, and dimethyldithiocarbamate, and combinations thereof. Additional examples are disclosed in U.S. Pat. No. 7,005,479, the entire disclosure of which is hereby incorporated herein by reference.

Suitable disulfides include, but are not limited to, 4,4'-diphenyl disulfide; 4,4'-ditolyl disulfide; 2,2'-benzamido diphenyl disulfide; bis(2-aminophenyl) disulfide; bis(4-aminophenyl) disulfide; bis(3-aminophenyl) disulfide; 2,2'-bis(4-aminonaphthyl) disulfide; 2,2'-bis(3-aminonaphthyl) disulfide; 2,2'-bis(4-aminonaphthyl) disulfide; 2,2'-bis(5-aminonaphthyl) disulfide; 2,2'-bis(6-aminonaphthyl) disulfide; 2,2'-bis(7-aminonaphthyl) disulfide; 2,2'-bis(8-aminonaphthyl) disulfide; 1,1'-bis(2-aminonaphthyl) disulfide; 1,1'-bis(3-aminonaphthyl) disulfide; 1,1'-bis(3-aminonaphthyl) disulfide; 1,1'-bis(4-aminonaphthyl) disulfide; 1,1'-bis(5-aminonaphthyl) disulfide; 1,1'-bis(6-aminonaphthyl) disulfide; 1,1'-bis(7-aminonaphthyl) disulfide; 1,1'-bis(8-aminonaphthyl) disulfide; 1,2'-diamino-1,2'-dithiodinaphthalene; 2,3'-diamino-1,2'-dithiodinaphthalene; bis(4-chlorophenyl) disulfide; bis(2-chlorophenyl) disulfide; bis(3-chlorophenyl) disulfide; bis(4-bromophenyl) disulfide; bis(2-bromophenyl) disulfide; bis(3-bromophenyl) disulfide; bis(4-fluorophenyl) disulfide; bis(4-iodophenyl) disulfide; bis(2,5-dichlorophenyl) disulfide; bis(3,5-dichlorophenyl) disulfide; bis (2,4-dichlorophenyl) disulfide; bis(2,6-dichlorophenyl) disulfide; bis(2,5-dibromophenyl) disulfide; bis(3,5-dibromophenyl) disulfide; bis(2-chloro-5-bromophenyl) disulfide; bis(2,4,6-trichlorophenyl) disulfide; bis(2,3,4,5,6-pentachlorophenyl) disulfide; bis(4-cyanophenyl) disulfide; bis (2-cyanophenyl) disulfide; bis(4-nitrophenyl) disulfide; bis (2-nitrophenyl) disulfide; 2,2'-dithiobenzoic acid ethylester; 2,2'-dithiobenzoic acid methylester; 2,2'-dithiobenzoic acid; 4,4'-dithiobenzoic acid ethylester; bis(4-acetylphenyl) disulfide; bis(2-acetylphenyl) disulfide; bis(4-formylphenyl) disulfide; bis(4-carbamoylphenyl) disulfide; 1,1'-dinaphthyl disulfide; 2,2'-dinaphthyl disulfide; 1,2'-dinaphthyl disulfide; 2,2'-bis(1-chlorodinaphthyl) disulfide; 2,2'-bis(1-bromonaphthyl) disulfide; 1,1'-bis(2-chloronaphthyl) disulfide; 2,2'-bis(1-cyanonaphthyl) disulfide; 2,2'-bis(1-acetylnaphthyl) disulfide; and the like; and combinations thereof.

Suitable inorganic sulfide compounds include, but are not limited to, titanium sulfide, manganese sulfide, and sulfide analogs of iron, calcium, cobalt, molybdenum, tungsten, copper, selenium, yttrium, zinc, tin, and bismuth.

Suitable Group VIA compounds include, but are not limited to, elemental sulfur and polymeric sulfur, such as those which are commercially available from Elastochem, Inc. of Chardon, Ohio; sulfur catalyst compounds which include PB(RM-S)-80 elemental sulfur and PB(CRST)-65 polymeric sulfur, each of which is available from Elastochem, Inc; tellurium catalysts, such as TELLOY®, and selenium catalysts, such as VANDEX®, each of which is commercially available from RT Vanderbilt Company, Inc.

Suitable substituted and unsubstituted aromatic organic components that do not include sulfur or a metal include, but are not limited to, 4,4'-diphenyl acetylene, azobenzene, and combinations thereof. The aromatic organic group preferably ranges in size from $C_6$ to $C_{20}$, and more preferably from $C_6$ to $C_{10}$.

Suitable substituted and unsubstituted aromatic organometallic compounds include, but are not limited to, those having the formula $(R_1)_x$—$R_3$-M-$R_4$—$(R_2)_y$, wherein $R_1$ and $R_2$ are each hydrogen or a substituted or unsubstituted $C_{1-20}$ linear, branched, or cyclic alkyl, alkoxy, or alkylthio group, or a single, multiple, or fused ring $C_6$ to $C_{24}$ aromatic group; x and y are each an integer from 0 to 5; $R_3$ and $R_4$ are each selected from a single, multiple, or fused ring $C_6$ to $C_{24}$ aromatic group; and M includes an azo group or a metal component. Preferably, $R_3$ and $R_4$ are each selected from a $C_6$ to $C_{10}$ aromatic group, more preferably selected from phenyl, benzyl, naphthyl, benzamido, and benzothiazyl. Preferably $R_1$ and $R_2$ are each selected from substituted and unsubstituted $C_{1-10}$ linear, branched, and cyclic alkyl, alkoxy, and alkylthio groups, and $C_6$ to $C_{10}$ aromatic groups. When $R_1$, $R_2$, $R_3$, and $R_4$ are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl and sulfonamide; and phosphates and phosphites. When M is a metal component, it may be any suitable elemental metal. The metal is generally a transition metal, and is preferably tellurium or selenium.

Suitable hydroquinones include, but are not limited to, compounds represented by the following formula, and hydrates thereof:

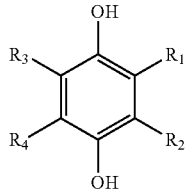

wherein each $R_1$, $R_2$, $R_3$, and $R_4$ is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Particularly preferred hydroquinones include compounds represented by the above formula, and hydrates thereof, wherein each $R_1$, $R_2$, $R_3$, and $R_4$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Examples of particularly suitable hydroquinones include, but are not limited to, hydroquionone; tetrachlorohydroquinone; 2-chlorohydroquionone; 2-bromohydroquinone; 2,5-dichlorohydroquinone; 2,5-dibromohydroquinone; tetrabromohydroquinone; 2-methylhydroquinone; 2-t-butylhydroquinone; 2,5-di-t-amylhydroquinone; and 2-(2-chlorophenyl) hydroquinone hydrate. Hydroquinone and tetrachlorohydroquinone are particularly preferred, and even more particularly preferred is 2-(2-chlorophenyl) hydroquinone hydrate. Suitable hydroquinones are further disclosed, for example, in U.S. Patent Application Publication No. 2007/0213440, the entire disclosure of which is hereby incorporated herein by reference.

Suitable benzoquinones include compounds represented by the following formula, and hydrates thereof:

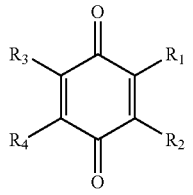

wherein each $R_1$, $R_2$, $R_3$, and $R_4$ is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Particularly preferred benzoquinones include compounds represented by the above formula, and hydrates thereof, wherein each $R_1$, $R_2$, $R_3$, and $R_4$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Methyl p-benzoquinone and tetrachloro p-benzoquinone are more particularly preferred. Suitable benzoquinones are further disclosed, for example, in U.S. Patent Application Publication No. 2007/0213442, the entire disclosure of which is hereby incorporated herein by reference.

Suitable quinhydrones include, but are not limited to, compounds represented by the following formula, and hydrates thereof:

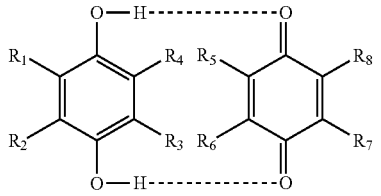

wherein each $R_1$, $R_2$, $R_3$, $R_4$, $R_5$, $R_6$, $R_7$, and $R_8$ is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Particularly preferred quinhydrones include compounds represented by the above formula, and hydrates thereof, wherein each $R_1$, $R_2$, $R_3$, $R_4$, $R_5$, $R_6$, $R_7$, and $R_8$ is independently selected from the group consisting of: a metal salt of a carboxyl group (e.g., —$COO^-M^+$), an acetate group (—$CH_2COOH$) and esters thereof (—$CH_2COOR$), a hydroxy group (—OH), a metal salt of a hydroxy group (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Particularly preferred quinhydrones also include compounds represented by the above formula wherein each $R_1$, $R_2$, $R_3$, $R_4$, $R_5$, $R_6$, $R_7$, and $R_8$ is hydrogen. Suitable quinhydrones are further disclosed, for example, in U.S. Patent Application Publication No. 2007/0213441, the entire disclosure of which is hereby incorporated herein by reference.

Suitable catechols include compounds represented by the following formula, and hydrates thereof:

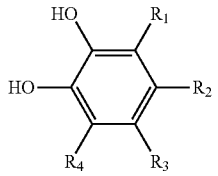

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). Suitable catechols are further disclosed, for example, in U.S. Patent Application Publication No. 2007/0213144, the entire disclosure of which is hereby incorporated herein by reference.

Suitable resorcinols include compounds represented by the following formula, and hydrates thereof:

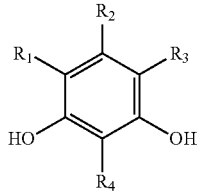

wherein each $R_1$, $R_2$, $R_3$, and $R_4$, is independently selected from the group consisting of hydrogen, a halogen group (F, Cl, Br, I), an alkyl group, a carboxyl group (—COOH) and metal salts thereof (e.g., —$COO^-M^+$) and esters thereof (—COOR), an acetate group (—$CH_2COOH$) and esters thereof (—$CH_2COOR$), a formyl group (—CHO), an acyl group (—COR), an acetyl group (—$COCH_3$), a halogenated carbonyl group (—COX), a sulfo group (—$SO_3H$) and esters thereof (—$SO_3R$), a halogenated sulfonyl group (—$SO_2X$), a sulfino group (—$SO_2H$), an alkylsulfinyl group (—SOR), a carbamoyl group (—$CONH_2$), a halogenated alkyl group, a cyano group (—CN), an alkoxy group (—OR), a hydroxy group (—OH) and metal salts thereof (e.g., —$O^-M^+$), an amino group (—$NH_2$), a nitro group (—$NO_2$), an aryl group (e.g., phenyl, tolyl, etc.), an aryloxy group (e.g., phenoxy, etc.), an arylalkyl group [e.g., cumyl (—$C(CH_3)_2$phenyl); benzyl (—$CH_2$phenyl)], a nitroso group (—NO), an acetamido group (—$NHCOCH_3$), and a vinyl group (—CH═$CH_2$). 2-Nitroresorcinol is particularly preferred. Suitable resorcinols are further disclosed, for example, in U.S. Patent Application Publication No. 2007/0213144, the entire disclosure of which is hereby incorporated herein by reference.

When the rubber composition includes one or more hydroquinones, benzoquinones, quinhydrones, catechols, resorcinols, or a combination thereof, the total amount of hydroquinone(s), benzoquinone(s), quinhydrone(s), catechol(s), and/or resorcinol(s) present in the composition is typically at least 0.1 parts by weight or at least 0.15 parts by weight or at least 0.2 parts by weight per 100 parts of the base rubber, or an amount within the range having a lower limit of 0.1 parts or 0.15 parts or 0.25 parts or 0.3 parts or 0.375 parts by weight per 100 parts of the base rubber, and an upper limit of 0.5 parts or 1 part or 1.5 parts or 2 parts or 3 parts by weight per 100 parts of the base rubber.

In a particular embodiment, the soft and fast agent is selected from zinc pentachlorothiophenol, pentachlorothiophenol, ditolyl disulfide, diphenyl disulfide, dixylyl disulfide, 2-nitroresorcinol, and combinations thereof.

Suitable types and amounts of base rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Patent Application Publication No. 2007/0093318, the entire disclosure of which is hereby incorporated herein by reference.

Also suitable for forming the inner core layer(s) are thermosetting compositions selected from the group consisting of polyurethanes, polyureas, urethane ionomers, urea ionomers, epoxies, polyamides, polyesters, polyurethane acrylates, polyurea acrylates, epoxy acrylates, silicones, polyimides, and blends and copolymers of two or more thereof.

Suitable thermoplastic polymer compositions for forming the inner core layer(s) include, but are not limited to, partially- and fully-neutralized ionomers and blends thereof, including blends of HNPs with partially neutralized ionomers (as disclosed, for example, in U.S. Application Publication No. 2006/0128904), blends of HNPs with additional thermoplastic and thermoset materials (such as acid copolymers, engineering thermoplastics, fatty acid/salt-based HNPs, polybutadienes, polyurethanes, polyureas, polyesters, thermoplastic elastomers, and other conventional polymer materials), and particularly the ionomer compositions disclosed, for example, in U.S. Pat. Nos. 6,653,382, 6,756,436, 6,777,472, 6,894,098, 6,919,393, and 6,953,820. Suitable HNP compositions also include those disclosed, for example, in U.S. Pat. Nos. 6,653,382, 6,756,436, 6,777,472, 6,894,098, 6,919,393, and 6,953,820. The entire disclosure of each of the above references is hereby incorporated herein by reference.

Also suitable for forming the inner core layer(s) are graft copolymers of ionomer and polyamide; and the following non-ionomeric polymers, including homopolymers and copolymers thereof, as well as their derivatives that are compatibilized with at least one grafted or copolymerized functional group, such as maleic anhydride, amine, epoxy, isocyanate, hydroxyl, sulfonate, phosphonate, and the like: polyesters, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly (ethylene naphthenate), and those disclosed in U.S. Pat. Nos. 6,353,050, 6,274,298, and 6,001,930, and blends of two or more thereof; polyamides, polyamide-ethers, and polyamide-esters, and those disclosed in U.S. Pat. Nos. 6,187,864, 6,001,930, and 5,981,654, and blends of two or more thereof; thermosetting and thermoplastic polyurethanes, polyureas, polyurethane-polyurea hybrids, and blends of two or more thereof; fluoropolymers, such as those disclosed in U.S. Pat. Nos. 5,691,066, 6,747,110 and 7,009,002, and blends of two or more thereof; non-ionomeric acid polymers, such as E/Y- and E/X/Y-type copolymers, wherein E is an olefin (e.g., ethylene), Y is a carboxylic acid such as acrylic, methacrylic, crotonic, maleic, fumaric, or itaconic acid, and X is a softening comonomer such as vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons; and blends of two or more thereof; metallocene-catalyzed polymers, such as those disclosed in U.S. Pat. Nos. 6,274,669, 5,919,862, 5,981,654, and 5,703,166, and blends of two or more thereof; polystyrenes, such as poly(styrene-co-maleic anhydride), acrylonitrile-butadiene-styrene, poly (styrene sulfonate), polyethylene styrene, and blends of two or more thereof; polypropylenes and polyethylenes, particularly grafted polypropylene and grafted polyethylenes that are modified with a functional group, such as maleic anhydride of sulfonate, and blends of two or more thereof; polyvinyl chlorides and grafted polyvinyl chlorides, and blends of two or more thereof; polyvinyl acetates, preferably having less than about 9% of vinyl acetate by weight, and blends of two or more thereof; polycarbonates, blends of polycarbonate/acrylonitrile-butadiene-styrene, blends of polycarbonate/polyurethane, blends of polycarbonate/polyester, and blends of two or more thereof; polyvinyl alcohols, and blends of two or more thereof; polyethers, such as polyarylene ethers, polyphenylene oxides, block copolymers of alkenyl aromatics with vinyl aromatics and poly(amic ester)s, and blends of two or more thereof; polyimides, polyetherketones, polyamideimides, and blends of two or more thereof; polycarbonate/polyester copolymers and blends; and combinations of any two or more of the above polymers. Also suitable are the thermoplastic compositions disclosed in U.S. Pat. Nos. 5,919,100, 6,872,774 and 7,074,137. The entire disclosure of each of the above references is hereby incorporated herein by reference.

Examples of suitable commercially available thermoplastics include, but are not limited to, Pebax® thermoplastic polyether block amides, commercially available from Arkema Inc.; Surlyn® ionomer resins, Hytrel® thermoplastic polyester elastomers, and ionomeric materials sold under the trade names DuPont® HPF 1000 and HPF 2000, all of which are commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; Clarix® ionomer resins, commercially available from A. Schulman Inc.; Elastollan® polyurethane-based thermoplastic elastomers, commercially available from BASF; and Xylex® polycarbonate/polyester blends, commercially available from SABIC Innovative Plastics. The thermoplastic composition may be treated or admixed with a thermoset diene composition to reduce or prevent flow upon overmolding. Optional treatments may also include the addition of peroxide to the material prior to molding, or a post-molding treatment with, for example, a crosslinking solution, electron beam, gamma radiation, isocyanate or amine solution treatment, or the like. Such treatments may prevent the intermediate layer from melting and flowing or "leaking" out at the mold equator, as the thermoset outer core layer is molded thereon at a temperature necessary to crosslink the outer core layer, which is typically from 280° F. to 360° F. for a period of about 5 to 30 minutes.

In addition to the above materials, the inner core layer may include at least one layer formed from a low deformation material selected from metal, rigid plastics, polymers reinforced with high strength organic or inorganic fillers or fibers, and blends and composites thereof. Suitable low deformation materials also include those disclosed in U.S. Patent Application Publication No. 2005/0250600, the entire disclosure of which is hereby incorporated herein by reference.

Additional materials suitable for forming the inner core layer(s) include the core compositions disclosed in U.S. Pat. No. 7,300,364, the entire disclosure of which is hereby incorporated herein by reference. For example, suitable inner core layer materials include HNPs neutralized with organic fatty acids and salts thereof, metal cations, or a combination of both. In addition to HNPs neutralized with organic fatty acids and salts thereof, inner core layer compositions may comprise at least one rubber material having a resilience index of at least about 40. Preferably the resilience index is at least about 50. Polymers that produce resilient golf balls and, therefore, are suitable for the present invention, include but are not limited to CB23, CB22, commercially available from LANXESS® Corporation, BR60, commercially available from Enichem, and 1207G, commercially available from Goodyear Corp. Additionally, the unvulcanized rubber, such as polybutadiene, in golf balls prepared according to the invention typically has a Mooney viscosity of between about 40 and about 80, more preferably, between about 45 and about 65, and most preferably, between about 45 and about 55. Mooney viscosity is typically measured according to ASTM-D1646.

The inner core is enclosed with an intermediate core, which is single-, dual-, or multi-layered, and preferably has an overall thickness within a range having a lower limit of 0.005 or 0.010 or 0.020 or 0.025 or 0.035 or 0.040 or 0.045 inches and an upper limit of 0.045 or 0.050 0.060 or 0.070 or 0.080 or 0.090 or 0.100 inches.

The intermediate core has an outer surface hardness of 40 Shore C or greater, or 70 Shore C or greater, or 80 Shore C or greater, or 85 Shore C or greater, or 89 Shore C or greater, or 90 Shore C or greater, or 95 Shore C or greater, or 63 Shore D or greater, or 65 Shore D or greater, or 70 Shore D or greater, or 75 Shore D or greater, or 80 Shore D or greater, or 85 Shore D or greater, or 90 Shore D or greater, or 95 Shore D or greater, or an outer surface hardness within a range having a lower limit of 40 or 45 or 50 or 80 or 85 or 89 Shore C and an upper limit of 80 or 85 or 90 or 93 or 95 Shore C, wherein the upper limit is greater than the lower limit (e.g., when the lower limit is 85, the upper limit is 90, 93, or 95). The intermediate core preferably has a Shore D outer surface hardness within a range having a lower limit of 20 or 30 or 35 or 40 or 45 or 50 or 55 or 57 or 58 or 60 or 63 or 65 or 66 or 70 or 75 and an upper limit of 60 or 65 or 66 or 70 or 72 or 75 or 80 or 85 or 90 or 93 or 95, wherein the upper limit is greater than the lower limit (e.g., when the lower limit is 65, the upper limit is 66, 70, 72, 75, 80, 85, 90, 93, or 95).

The intermediate core includes at least one layer formed from a metallic, composite, or inorganic/organic hybrid composition.

Suitable metal materials include, but are not limited to, aluminum, brass, chromium, copper, iron, lead, magnesium, molybdenum, nickel, nickel-silver, niobium, silver, steel, tantalum, tin, titanium, titanium/nickel alloy, tungsten, vanadium, and zinc. Steel, titanium, chromium, nickel, and alloys thereof, including, but not limited to, nickel-titanium alloys, copper-zinc-aluminum alloys, and copper-aluminum-nickel alloys, are preferred. Also suitable are the metals disclosed in U.S. Pat. Nos. 6,004,225 and 6,142,887, the entire disclosures of which are hereby incorporated herein by reference.

Suitable composite materials comprise a matrix material and a filament material embedded in the matrix material. In golf balls of the invention, the composite material advantageously may include functionalized nanostructures as the filament material portion of the composite material or composition.

One process for functionalizing nano-structures, such as carbon nanotubes and/or graphene, may be performed as disclosed in U.S. Pat. No. 9,597,677 of Campidelli et al. ("the '677 patent"), hereby incorporated by reference herein in its entirety. A method is disclosed therein for functionalizing carbon nano-objects by forming at least one layer of a crosslinked polymer around these nano-objects, which method comprises at least the following steps:

a) dispersing nano-objects in an aqueous solution of a surfactant to obtain a suspension in which each nano-object is surrounded by surfactant molecules, the hydrophobic portion of these molecules being oriented towards the nano-object and the hydrophilic portion of said molecules being in contact with the water of the suspension;

b) mixing the thereby obtained suspension with a solution comprising one or several organic and/or organo-inorganic monomers in an organic solvent non-miscible with water, the monomer(s) having a dichloromethane/deionized water partition coefficient at least equal to five at a temperature of 25° C. and including at least three polymerizable chemical groups, optionally protected with a protective group, this mixture being made with stirring in order to bring the solution of monomer(s) to the interface between the nano-objects and the surfactant molecules which surround these nano-objects;

c) removing the organic solvent from the mixture;

d) polymerizing and crosslinking the monomer(s) at the interface between the nano-objects and the surfactant molecules which surround these nano-objects, after deprotection of the polymerizable chemical groups if the latter are protected, to obtain the formation of a crosslinked polymer layer around the nano-objects, this layer being itself surrounded by surfactant molecules;

e) removing the surfactant molecules which surround the layer of crosslinked polymer; and f) recovering the thereby functionalized nano-objects.

Thus, not only one or several monomer(s) is(are) used, which each include at least three polymerizable chemical groups, which allows formation of a lattice formed with a crosslinked polymer around the nano-objects for which functionalization is desired, but further the polymerization/crosslinking reaction, which leads to formation of this lattice, is conducted at the interface between the nano-objects and the surfactant molecules which surround these nano-objects (and not at the interface between the surfactant molecules and the water of the suspension). The polymer lattice is therefore formed as close as possible to the surface of the nano-objects and this without confining surfactant molecules.

The result of this is that the method of the invention leads to functionalized nano-objects which are extremely stable and resistant, which may be easily handled and notably purified without any risk of alteration or loss of material.

By "carbon nano-objects" are meant objects consisting of carbon and which have, according to the ISO TS 80004-3: 2010 standard, one, two or three external dimensions at a nanometric scale, i.e. ranging from 1 to 100 nm. Within the scope of the invention, these are typically single- or multi-walled carbon nanotubes, or single- or multilayer nanosheets. However, these may also be carbon nanofibers or carbon nano-onions.

Moreover, by "polymer" is meant both a homopolymer which is derived from a single monomer and which is therefore formed with a single recurrent unit, and a copolymer which is derived from several (i.e. two or more than two) different monomers and which is therefore formed with several different recurrent units.

This is the reason why the organic solution used in step (b) of the method of the invention may comprise a single monomer or, on the contrary, a plurality of different monomers, depending on whether the intention is to functionalize the nano-objects with at least one layer of a crosslinked homopolymer and with at least one layer of a crosslinked copolymer.

The monomer(s) which may be used within the scope of the invention may be selected from very many organic or organo-inorganic compounds provided that these compounds meet the following two conditions: (1) have a dichloromethane/water partition coefficient at least equal to 5 at a temperature of 25° C., in order to be able to impart to the narrow objects a capability of being dispersed and individualized in organic solvents; and (2) include at least three polymerizable chemical groups, in order to allow formation of a crosslinked polymer lattice around these nano-objects.

The partition coefficient, generally noted as K, of a compound between two non-miscible solvents is equal to the ratio of the molar concentrations which this compound has in the solvents, after having been added to a medium comprising both solvents in contact with each other and left free to be distributed between each other, these operations being carried out at a given temperature θ.

The solvents to be taken into consideration for determining the partition coefficient of a compound are dichloromethane and deionized water so that this partition coefficient corresponds to the ratio between the molar concentration which this compound has in dichloromethane and the molar concentration which the same compound has in deionized water, while the temperature .theta. to be taken into consideration is 25° C.

The dichloromethane/deionized water partition coefficient of a compound may notably be determined by the so-called "stirred flask" or "by stirring in a flask" method, which to this day remains one of the most reliable methods for determining the partition coefficients of a compound between two non-miscible solvents. This method consists of adding, into a flask, a known amount of the compound to a region formed by both solvents with equal portions, of stirring the flask, of letting both phases in presence decant. The concentration of the compound is then measured in each of the phases, for example by UV-visible spectroscopy. The measurements are preferably made three times and the partition coefficient is determined by calculating the average of these measurements.

Compounds which may be used as monomers in the method of the invention may notably be compounds provided with a chromophore, i.e. a group of atoms which includes one or several double bonds and which forms with the remainder of the molecule an alternation of double and single bonds. Such compounds may actually be used for imparting particular optical properties to the nano-objects, for example adsorption of photons and transfer of these photons and/or of photo-induced charges.

Thus, these may notably be compounds which comprise an azobenzene, anthraquinone, indigotin, triarylmethane group such as a triphenylmethane group, acridine, xanthene, .beta.-carotene, quinoline, chlorin, porphyrin, phthalocyanin, naphthalocyanin, fluorescein, rhodamine, BODIPY (bore-dipyromethene), coumarin or cyanin group (for example, of the cyanin 3, cyanin 5 or cyanin 7 type), properly substituted in order to include at least three polymerizable chemical groups.

When this is a chlorin, porphyrin, phthalocyanin or naphthalocyanin group, this group may be in the form of a free base, in which case it is devoid of any metal atom or, on the contrary it may be metallated, i.e. coordinated to a metal cation, typically a transition metal atom such as zinc, copper, nickel, cobalt, iron, gold or platinum.

Compounds which may be used as monomers in the method of the invention may also be complexes of a transition metal, in which this metal is coordinated to several molecules of a same organic ligand (the complex is then said to be homoleptic) or with several molecules corresponding to different organic ligands (the complex is then said to be heteroleptic). Depending on the transition metal which they comprise, such complexes may in fact be used for imparting to the nano-objects, catalysis, photocatalysis, magnetism properties, etc, notably useful for applications in electrochemistry.

Thus, for example, these may be of hexapyridine, tris(2,2'-bipyridine) or bis(2,2':6',2'-terpyridine) complexes of iron, cobalt or ruthenium, for which the pyridine, 2,2'-bipyridine or 2,2':6',2'-terpyridine molecules have been properly substituted so that these complexes may include at least three polymerizable chemical groups.

Compounds which may be used as monomers in the method of the invention may also be complexes of a rare earth (or lanthanide), in which the rare earth is coordinated to several molecules of a same organic ligand (the complex is then said to be homoleptic) or with several molecules corresponding to different organic ligands (the complex is then said to be heteroleptic), the ligand(s) may notably be compounds comprising a porphyrin or phthalocyanin group.

According to the rare earth which they comprise, such complexes may be used for imparting to the nano-objects, magnetic properties (for example, if the rare earth is terbium or holmium) or luminescence properties (for example if the rare earth is europium).

Compounds which may be used as monomers in the method of the invention may further consist in inorganic nanoparticles stabilized with an organic ligand.

These nanoparticles may notably be nanoparticles of a metal such as gold, of a metal alloy, of a semi-conductor such as germanium or tellurium, of an alloy with semi-conducting properties such as cadmium selenide CdSe or cadmium telluride CdTe, or a metal oxide such as titanium oxide $TiO_2$ or iron oxide (II,III), according to the properties (photocatalysis, magnetism, etc.) which are desired to be imparted to the nano-objects.

As for the polymerizable chemical groups, which the monomer(s) include(s), they may notably be thiol, selenol, real alkyne groups (also called terminal alkynes), cyclooctyn, azide, maleimide, diene, dienophile and/or haloacetyl groups, for example, bromo- or iodoacetyl groups.

According to the invention, the monomer(s) may include polymerizable chemical groups of a single type, in which case these polymerizable chemical groups are preferably thiol groups, selenol groups or real alkyne groups.

Alternatively, the monomer(s) may include polymerizable chemical groups of two different types, in which case these polymerizable chemical groups are, preferably, selected from the following pairs: thiol/maleimide, thiol/haloacetyl, real alkyne/azide, cyclooctyn/azide and diene/dienophile.

Within the scope of the invention, it is most particularly preferred that the polymerizable chemical groups be thiol groups or selenol groups because, during the polymerization/crosslinking of the monomer(s), these groups lead, for the first ones, to the formation of —S—S— bonds, and for the second ones, to the formation of —Se—Se— bonds, which may be subsequently described by means of an inorganic reducing agent of the hydride type (sodium borohydride, lithium aluminohydride, diisobutyl-aluminium hydride or the like) or by reaction with an excess of a thiolated compound (2-mercaptoethanol, dithiothreitol or the like) on a slightly alkaline aqueous medium.

Thus, the use of thiol or selenol groups as polymerizable chemical groups, provides the possibility of getting rid subsequently of the nano-objects having been functionalized with the method of the invention from the polymer layer which surrounds them and of recycling these nano-objects if desired.

Moreover, it is also preferred that the monomer(s) should include at least four polymerizable chemical groups and that the polymerizable chemical groups be located at the end of the spacer groups which the monomer(s) include(s), notably for avoiding steric hindrance problems. These spacer groups advantageously are typically saturated linear hydrocarbon groups which comprise from 2 to 8 carbon atoms and optionally one or several heteroatoms.

The surfactant may be any known surfactant for allowing dispersion of carbon nano-objects in an aqueous solution. Thus, this may notably be sodium cholate, sodium dodecylsulfate, sodium 4-dodecyl-benzenesulfonate, trimethyl-cetylammonium bromide, a polysorbate such as Tween™ 20, or further a surfactant which is marketed under the name of Triton X100™.

The dispersion of the nano-objects may notably be achieved by adding these nano-objects to an aqueous solution comprising the surfactant at a concentration at least equal to the critical micellar concentration (CMC) of this surfactant and preferably, at least equal to 1.2 times this CMC, and by subjecting the whole to sonication. If need be, the thereby obtained suspension may be centrifuged in order to remove the nano-objects which may have remained in the form of aggregates in spite of the sonication.

The following step, or step b), comprises the mixing of the suspension of nano-objects with a solution comprising the monomer(s) in an organic solvent non-miscible with water such as dichloromethane, chloroform or toluene, and this, with stirring in order to allow the solution of monomer(s) to penetrate between the surfactant molecules which surround the nano-objects and to reach the interface between these nano-objects and these molecules.

The mixing of the suspension of nano-objects with the solution of monomer(s) may be achieved by adding this suspension to this solution (or vice versa) and by subjecting the whole to sonication.

It should be noted that at this stage, the monomer(s) may be present in the organic solvent in a form in which their polymerizable chemical groups are protected by a protective group, if the latter tend to react spontaneously, notably in the presence of oxygen.

Thus, for example, in the case when the monomer(s) comprise thiol or selenol groups, each of these groups is advantageously protected, for example, with an acetyl, benzoyl group or the like.

The next step, or step c) comprises the removal of the organic solvent from the mixture, which may notably be carried out by raising the temperature of this mixture while subjecting it to sonication.

In this case, the temperature to which the mixture is brought should be sufficient for allowing evaporation of the organic solvent but should nevertheless be less than the temperature from which the arrangement of the molecules or surfactant around the nano-objects risks being destroyed.

To do this, it is desirable that the mixture be brought to a temperature which does not exceed 50° C., typically from 40 to 50° C. If this temperature is insufficient for evaporating the organic solvent, taking in to account the boiling temperature of this solvent (which will for example be the case if the organic solvent is toluene), then step c) is advantageously carried out by combining the rising of the temperature with applying a vacuum to the mixture.

The next step, or step d), comprises the polymerization and the crosslinking of the monomer(s) at the interface between the nano-objects and the surfactant molecules which surround these nano-objects, in order to obtain formation of a layer of a crosslinked polymer around the nano-objects, this layer being itself surrounded by surfactant molecules.

The conditions under which polymerization and crosslinking are achieved depend on the nature of the polymerizable chemical groups which the monomer(s) include, it being understood that it is desirable that these operations be carried out at a temperature which does not exceed 50° C. in order to avoid there also, destruction of the arrangement of the surfactant molecules around the nano-objects.

In the case when the polymerizable chemical groups of the monomer(s) are protected with a protective group, polymerization and crosslinking of the monomer(s) are preceded with deprotection of the polymerizable chemical groups.

Thus, for example, in the case when the monomer(s) include(s) thiol or selenol groups as polymerizable chemical groups and when these thiol or selenol groups are protected with an acetyl group, step d) advantageously comprises the treatment of the nano-objects obtained at the end of step c):

with a deacetylation agent of the hydroxylamine, hydrazine or ammonia type, which is used in excess relatively to the thiol or selenol groups, in order to deprotect these groups; and then with a base of the triethylamine or diisopropylethylamine type, which is also used in excess relatively to the thiol or selenol groups, under an oxidizing atmosphere, for example under oxygen flow, in order to induce polymerization and crosslinking of the monomer(s) by reaction of these groups with each other.

This treatment is preferably carried out at room temperature.

If need be, it is obvious that compounds with a nature for initiating and/or accelerating polymerization and crosslinking of the monomer(s) may be used in step d).

The next step, or step e), comprises the removal of the surfactant molecules which surround the crosslinked polymer layer.

This operation may notably be carried out by filtering the suspension of nano-objects obtained at the end of step d) on a membrane resistant to organic solvents and the porosity of which allows only retention of the nano-objects, for example a membrane in polytetrafluoroethylene (Teflon™) with a porosity of 0.2 μm, and by successively rinsing the nano-objects with large volumes of water and of different organic solvents such as methanol, acetone, tetrahydrofurane, N-methylpyrrolidone, dichloromethane and diethyl ether.

The functionalized nano-objects, thus cleared of the surfactant molecules which surrounded them as well as of the reaction residues (unreacted monomer(s), excess reagents), may then be recovered and easily dispersed, optionally with ultra-sound, in an organic solvent such as N-methylpyrrolidone or N,N-dimethylformamide.

Stable suspensions of carbon nano-objects are thus obtained, which may be diluted with many organic solvents (methanol, ethanol, ethyl acetate, tetrahydrofurane, dichloromethane, chloroform, toluene, etc.) and thus kept either diluted or not for several months without any risk of precipitation.

Further, the functionalized nano-objects present in the suspensions may easily be separated from the organic solvent in which they are found, by example by filtration, and be subject to subsequent manipulations without any risk of alteration of their structure and/or of their properties.

Thus, it is notably possible to complete the functionalization of these nano-objects by forming, on the crosslinked polymer layer which surrounds them, one or several additional layers of crosslinked polymer(s), in which case the succession of steps a) to f) of this method is repeated as many times as the number of additional crosslinked polymer(s) layers, the formation of which is desired.

The method of the invention in addition to the aforementioned advantages has those: of providing a wide choice of functionalizations since the functionalization may be both achieved in the form of a layer or of several layers of polymer(s), these layers may be both identical with each other or different from each other, of an exclusively organic nature and as well of an organo-inorganic nature, and may both comprise a homopolymer and a copolymer; of being applicable to any kinds of carbon nano-objects: single-walled nanotubes of the CoMoCAT™ type as marketed by Sigma-Aldrich under references SG 65 and SG 76, nanotubes produced by laser ablation, single- or multi-walled nanotubes as marketed by Nanocyl, single-walled carbon nanotubes as marketed by Carbon Solutions, Inc., graphene nanosheets as marketed by Nanointegris under the name of Puresheets™ Mono or Quattro, etc.; and of only applying operations which may be carried out in an aqueous medium and under mild conditions, notably in terms of temperature, since these operations may be either carried out at room temperature or at temperatures not very far from room temperature.

An object of the invention is also a composition which comprises carbon nano-objects suspended in an organic solvent and in which the carbon nano-objects are surrounded by at least one layer of a crosslinked polymer.

As mentioned earlier, these nano-objects are typically carbon nanotubes or graphene.

Meanwhile, U.S. Pat. No. 8,986,515 ("'515 patent") discloses a combined production-functionalization process for producing a chemically functionalized nano graphene material from a halogenated graphite material and an azide or bi-radical compound, comprising: (A) Producing exfoliated halogenated graphite from said halogenated graphite material, wherein said graphite material is selected from the group consisting of carbon fiber, graphite fiber, carbon nano-fiber, graphitic nano-fiber, meso-carbon micro-bead, graphitized coke, and combinations thereof; (B) Dispersing said exfoliated halogenated graphite and said azide or bi-radical compound in a liquid medium to form a suspension; and (C) Subjecting said suspension to ultrasonication with ultrasonic waves of a desired intensity for a length of time sufficient to produce nano graphene platelets and to enable a chemical reaction to occur between said nano graphene platelets and said azide or bi-radical compound to produce said functionalized nano graphene material.

The chemical reaction may occur only to an edge or edges of said nano graphene platelets. Alternatively, the chemical reaction may occur to an edge and at least one primary surface of said nano graphene platelets.

The azide or bi-radical compound may be selected from the group consisting of 2-Azidoethanol, 3-Azidopropan-1-amine, 4-(2-Azidoethoxy)-4-oxobutanoic acid, 2-Azidoethyl-2-bromo-2-methylpropanoate, chlorocarbonate, azidocarbonate, dichlorocarbene, carbene, aryne, nitrene, (R—)-oxycarbonyl nitrenes, where R=any one or combination of the groups disclosed in the '515 patent.

Alternatively, in a combined production-functionalization process for producing a chemically functionalized nano graphene material from a halogenated graphite material and an azide or bi-radical compound, said graphite material is selected from the group consisting of carbon fiber, graphite fiber, carbon nano-fiber, graphitic nano-fiber, meso-carbon micro-bead, graphitized coke, and combinations thereof; said process comprising: (A) Dispersing said halogenated graphite material and the azide or bi-radical compound in a liquid medium to form a suspension; (B) Subjecting said suspension to ultrasonication with ultrasonic waves of a desired intensity for a length of time sufficient to produce nano graphene platelets and to enable a chemical reaction to occur between said nano graphene platelets and said azide or bi-radical compound to produce said functionalized nano graphene material.

The azide or bi-radical compound may be added to said liquid medium sequentially after said direct ultrasonication of said graphite material is allowed to proceed for a desired period of time.

The graphite material may be selected from the group consisting of natural graphite, artificial graphite, highly oriented pyrolytic graphite, carbon fiber, graphite fiber, carbon nano-fiber, graphitic nano-fiber, meso-carbon micro-bead, graphitized coke, and combinations thereof.

The chemical reaction may occur only to an edge or edges of said nano graphene platelets. The chemical reaction may occur to an edge and at least one primary surface of said nano graphene platelets.

The azide compound may be selected from the group consisting of 2-Azidoethanol, 3-Azidopropan-1-amine, 4-(2-Azidoethoxy)-4-oxobutanoic acid, 2-Azidoethyl-2-bromo-2-methylpropanoate, chlorocarbonate, azidocarbonate, dichlorocarbene, carbene, aryne, nitrene, (R—)-oxycarbonyl nitrenes, where R=any one or combination of the groups disclosed in the '515 patent.

The process may further comprise a step of grafting a polymer chain to a functional group of said functionalized nano graphene material to produce a polymer-grafted nano graphene material.

In yet another approach, the combined production-functionalization process for producing a chemically functionalized nano graphene material from a halogenated graphite material, comprises: (a) Producing exfoliated graphite from said halogenated graphite material, wherein said graphite material is selected from the group consisting of, carbon fiber, graphite fiber, carbon nano-fiber, graphitic nano-fiber, meso-carbon micro-bead, graphitized coke, and combinations thereof; (b) Dispersing said exfoliated graphite and an azide or bi-radical compound in a liquid medium to form a suspension; and (c) Subjecting said suspension to ultrasonication with ultrasonic waves of a desired intensity for a length of time sufficient to produce nano graphene platelets and to enable a chemical reaction to occur between said nano graphene platelets and said azide or bi-radical compound to produce said functionalized nano graphene material.

Additional suitable functionalized nano-structures, nano-compounds suitable for functionalizing, and/or methods/processes of functionalizing same are disclosed, for example, in U.S. Pat. Nos. 9,814,786; 9,591,979; 9,730,491; 9,096,925; 9,076,570; 8,530,613; and/or 7,572,855.

The functionalized nano-structures may also be mixed or otherwise combined with conductive nanoshelled structures. The conductive nanoshelled structures may comprise zinc oxide nanoshells, magnesium oxide nanoshells, or combinations thereof. The conductive nanoshelled structures may have surface cations selected from the group consisting of zinc, sodium, magnesium, lithium, potassium, and combinations thereof. The functionalized nano-structures and conductive nanoshelled structures are included in the composite composition in a ratio of 98:2 to 50:50.

As used herein, the term "conductive nanoshelled structures" refers to nanostructures containing a conductive shell, and includes for example conductive hollow nanoshells and nanorice particles such as described and detailed in *Formation and Stability of Hollow MgO Nanoshells*, Gopi Krishnan, G. Palasantzas, and B. J. Looi, Journal of Nanoscience and Nanotechnology, Vol. 10, pp. 104 (2010) ("*Hollow MgO Nanoshells*"); U.S. Pat. No. 8,217,143 of Kim et al. ("Kim 143"); and U.S. Pat. No. 8,217,143 of Wang et al. ("Wang"), each of which is hereby incorporated by reference herein in its entirety.

Meanwhile, the term "conductive" refers to atoms having outer electrons that are loosely bound and free to move through a material.

Due at least in part to such conductive properties, combined with a unique nanoshelled construction, each conductive nanoshelled particle of the plurality can interact with and readily disperse within the ingredients of a thermoset or thermoplastic composition portion of the mixture rather than agglomerating with other conductive nanoshelled particles. A strong polymer network is thereby created within the resulting polymer mixture with excellent intra-layer adhesion and cohesion and also displaying improved optical properties.

This conductive shell may (i) form within the inner surface of a molecule and encase a hollow space; and/or (ii) surround a nanoparticle core which may be solid or partially hollow.

In conductive shell construction (i), a void is formed in the center of a molecule when metal or otherwise conductive ions diffuse outward from the center faster than inward diffusion of vacancies, and the metal or otherwise conductive ions remaining in the center form a conductive shell about the resulting hollow center. Suitable examples of conductive hollow nanoshells for incorporating in the composite composition comprising functionalized nano-structures of golf balls of the invention are set forth in *Hollow MgO Nanoshells* and Kim '143, previously incorporated by reference herein in their entireties.

One particular example of a suitable conductive hollow nanoshell includes the hexagonally shaped hollow MgO nanoshells discussed in the *Hollow MgO Nanoshells* article, which, due to its construction, can easily and readily disperse within a thermoset or thermoplastic composition without being oriented since agglomeration of the hollow MgO nanoshells in the resulting mixture is substantially avoided.

Another particular example of a suitable conductive hollow nanoshell of construction type (i) includes a plurality of apoferritin molecules having empty core shells in which a substantially integral conductive nanoshell is formed. This occurs because the number of metal or otherwise conductive ions entering the hollow core is controlled to be sufficient to form the substantially integral conductive nanoshell but insufficient to completely fill the space and therefore will not form a spherical conductive core in the empty space. In this example, examples of suitable metal or otherwise conductive ions are of transition metals such as cobolt, iron, manganese, vanadium, nickel, zinc, copper or silver.

Conductive hollow nanoshells may be fabricated, for example, by admixing an aqueous solution of metal or otherwise conductive ions with an aqueous solution of apoferritin protein molecules, followed by admixing an aqueous solution containing an excess of an oxidizing agent for the metal or otherwise conductive ions. The apoferritin molecules serve as bio-templates for the formation of metal or otherwise conductive nanoshells, which form on and are bonded to the inside walls of the hollow cores of the individual apoferritin molecules. The number of metal or otherwise conductive atoms entering the hollow core of each individual apoferritin molecule may be controlled such that a hollow metal or otherwise conductive nanoshell results rather than formation of a solid spherical metal or otherwise conductive nanoparticle.

The thickness of the conductive shell can also be targeted by so controlling the number of metal or otherwise conductive ions entering the hollow core, with the limitation being that the number of metal or otherwise conductive ions entering the hollow core should be less than the amount that would completely fill the hollow core. Thus, the diameter of the hollow portion of a conductive hollow nanoshell will be less than the diameter of the core.

Hollow nanoshelled structures can be prepared by methods such as thermal evaporation, emulsion/water extraction techniques, hydrothermal approach and the template method and as otherwise set forth in the *Hollow MgO Nanoshells* article and Kim '143.

Meanwhile, in conductive nanoshelled structures of type (ii) (e.g., nanorice particles), a conductive shell coats or otherwise surrounds a nanostructure core. The core may be solid or partially hollow. When solid, the core may comprise a dielectric material. Examples include solid cores comprising a metal oxide, iron, cadmium, electric insulators, silicon dioxide, titanium dioxide, polymethyl methacrylate (PMMA), polystyrene, gold sulfide, macromolecules such as dendrimers, semiconductor materials, colloidal silica, or combinations thereof.

Meanwhile, the shell may comprise any conductive material such as gold, silver, copper, aluminum, titanium, or chromium. Embodiments are also envisioned wherein the core is surrounded by two or more shells. In such multi-shell embodiments, the shells can be formed of the same or different conductive materials. In other embodiments, one shell may be formed of a conductive material whereas an adjacent shell is formed of a non-conductive material.

Each nanorice particle has an aspect ratio which may be targeted by controlling the thickness of the conductive shell. For example, the shell may be thinner or thicker, and/or the shell may have a uniform thickness or a non-uniform thickness. In an embodiment wherein the shell thickness is non-uniform, in a particular embodiment, the shell thickness may taper from an equatorial region to a polar region, or vice versa.

Nanorice particles combine the intense local fields of nanorods with the highly tunable plasmon resonances of nanoshells. This geometry possesses far greater structural tunability than previous nanoparticle geometries, along with much larger local field enhancements and far greater sensitivity as a surface plasmon resonance (SPR) nanosensor than presently known dielectric-conductive material nanostructures. Nanorice nanoparticles may have a surface plasmon resonance sensitivity ranging from about 100 nm $RIU^{-1}$ (refractive index unit) to about 1500 $RIU^{-1}$, or from about 300 nm $RIU^{-1}$ to about 1200 $RIU^{-1}$, or from about 600 nm $RIU^{-1}$ to about 1000 $RIU^{-1}$. Conductive shell thickness can be varied to adjust the surface plasmon resonance sensitivity. The aspect ratio of the core or the aspect ratio of the nanorice particle as a whole may be adjusted (while the other remains unadjusted) to tune the surface plasmon resonance.

It is envisioned that each conductive nanoshelled structure may have a diameter, at its widest cross-section, of up to 1000 nm, or from about 2 nm to 1000 nm, or from about 2 nm to 10 nm, or from about 10 nm to 1000 nm, or from about 100 nm to about 800 nm, or from about 200 nm to about 500, or from about 10 nm to about 250 nm, or from 20 nm to about 100 nm, or from about 1 nm to about 500 nm.

The thickness of the shell of each conductive nano shelled structure can for example be within the range of from about 1 nm to about 100 nm, or from about 5 nm to about 50 nm, or from about 10 nm to about 40 nm. Non-limiting examples of how nanorice particles can be formed are set forth in the '066 patent.

A plurality of conductive nanoshelled structures may be mixed with a thermoset or thermoplastic composition prior to molding or otherwise being formed into a golf ball within any known golf ball manufacturing process. The plurality of conductive nanoshelled structures may in at least some embodiments be pre-mixed with one or more ingredients of the thermoset or thermoplastic composition formulation. In particular embodiments, the plurality of conductive nanoshelled structures may be mixed with the thermoset or thermoplastic composition (or pre-mixed with some ingredients thereof) under high shear conditions.

A plurality of conductive nanoshelled structures meanwhile has multifunctional versatility to target and improve a wide range of golf ball properties/characteristics without meanwhile negatively impacting durability. For example, zinc oxide or magnesium oxide nanoshells may be used as activators and/or accelerators in peroxide cured polybutadiene formulations.

In another example, hollow nanoshells having zinc, sodium, magnesium, lithium, potassium, or other cation on the surface thereof may serve as a neutralizing agent to form an ionomer from an acid functional polymer such as an ethylene-(meth) acrylic acid copolymer.

In yet another example, conductive nanoshelled structures can be incorporated to target specific gravity in rubber compositions, polyurethanes, polyureas, polyurethane/polyurea hybrids, and/or HNPs. In this regard, specific gravity of a layer is an important property because it can impact characteristics of the golf ball such as Moment of Inertia (MOI).

Meanwhile, conductive nanoshelled structures can be added as antioxidants, antiozonants and/or UV absorbers to preserve or promote the light emitting and/or light absorbing characteristics of golf ball materials which are vulnerable to deterioration when exposed to UV light on the course and produce an $\Delta Ecmc$ very close to 1—which is desirable, since the human eye generally cannot perceive color changes or differences within the CIELAB color space where the golf ball's color appearance has a color stability difference $\Delta Ecmc<1$.

In one embodiment, the plurality of conductive nanoshelled structures may be included in the composite composition comprising functionalized nano-structures in an amount of from about 2 wt % to about 50 wt %, or from about 2 wt % to about 10 wt %, or from 2 wt % to 10 wt % of the total weight of the mixture. In another embodiment, the plurality of conductive nanoshelled structures may be included in the composite composition comprising functionalized nano-structures in an amount of from about 10 wt % to about 35 wt %, or from 10 wt % to about 35 wt %, or from about 10 wt % to 35 wt %, or from 10 wt % to 35 wt % of the total weight of the mixture. In yet another embodiment, the plurality of conductive nanoshelled structures may be included in the composite composition comprising functionalized nano-structures in an amount of from about 25 wt % to about 75 wt %, or from 25 wt % to about 75 wt %, or from about 25 wt % to 75 wt %, or from 25 wt % to 75 wt % of the total weight of the mixture. In still another embodiment, the plurality of conductive nanoshelled structures may be included in the composite composition comprising functionalized nano-structures in an amount of at least 50 wt % of the total weight of the mixture.

In other embodiments, the plurality of conductive nanoshelled structures may be included in the composite composition comprising functionalized nano-structures in an amount ranging from about 2 wt % to about 15 wt % of the total weight of the mixture, or from about 10 wt % to about 40 wt % of the total weight of the mixture, or in an amount greater than 50 wt % of the total weight of the mixture, or in an amount greater than 5 wt % of the total weight of the mixture.

In a specific embodiment, each conductive hollow nanoshell may have a shell thickness to longitudinal diameter ratio of from about 1:3 to about 1:100. In other embodiments, each conductive hollow nanoshell may have a shell thickness to longitudinal diameter ratio of from about 1:3 to about 1:1000, or from about 1:3 to about 1:750, or from about 1:3 to about 1:500, or from about 1:3 to about 1:250, or from about 1:3 to about 1:150.

In another specific embodiment, each nanorice particle may have a longitudinal diameter of up to 1000 nm and a shell thickness of from 1 nm to 100 nm.

The matrix material may be molded about the filament material so that the filament material is embedded in the matrix material. In this embodiment, the matrix material can be a thermoset or a thermoplastic polymer. Suitable thermoset polymeric materials include, but are not limited to, unsaturated polyester resins, vinyl esters, epoxy resins, phenolic resins, polyurethanes, polyurea, polyimide resins, and polybutadiene resins. Suitable thermoplastics include, but are not limited to, polyethylene, polystyrene, polypropylene, thermoplastic polyesters, acrylonitrile butadiene styrene (ABS), acetal, polyamides including semicrystalline polyamide, polycarbonate (PC), shape memory polymers, polyvinyl chloride (PVC), polyurethane, trans-polybutadiene, liquid crystalline polymers, polyether ketone (PEEK), bio(maleimide), and polysulfone resins. The matrix material can also be a silicone material, such as a silicone polymer, a silicone elastomer, a silicone rubber, silicone resins, or a low molecular weight silicone fluid, thermoplastic silicone urethane copolymers and variations, and the likes. Silicone polymers include silicone homopolymers, silicone random copolymers, and silicone-organic (block) copolymers. Silicone elastomers are defined as high-molecular-weight linear polymers, usually polydimethysiloxanes. Silicone rubbers include commercially available gums, filler-reinforced gums, dispersions, and uncatalyzed and catalyzed compounds. Silicone resins contain Si atoms with no or only one organic substituent; they are therefore crosslinkable to harder and stiffer compounds than the elastomers. Low molecular weight silicone fluids including oligomers. Silicone materials are further disclosed, for example, in U.S. Pat. Nos. 6,162,134 and 6,159,110, the entire disclosures of which are hereby incorporated herein by reference. The matrix can also be formed of ionomers including highly neutralized polymers, or blends thereof with one or more of the above matrix materials. The specific formulations of these materials may include additives, fillers, inhibitors, catalysts and accelerators, and cure systems depending on the desired performance characteristics. The matrix material can be at least one polymer or a blend of polymers. In a preferred embodiment, the matrix material is Nylon, which is commercially available from BASF in Parsippany, N.J. under the name Ultramid.

Embodiments are envisioned wherein different filament materials may be mixed with or otherwise included in the composite composition including, but are not limited to, fibers of polymeric materials, glass materials, and metal fibers. The filament material may be comprised of strands or fibers having different physical properties to achieve desired stretch and elongation characteristics. Suitable polymeric filament materials include, but are not limited to, polyether urea, such as LYCRA®, poly(ester-urea), polyester block copolymers such as HYTREL®, poly(propylene), polyethylene, polyamide, acrylics, polyketone, poly(ethylene terephthalate) such as DACRON®, poly(p-phenylene terephthalamide) such as KEVLAR®, poly(acrylonitrile) such as ORLON®, trans-diaminodicyclohexylmethane and dodecanedicarboxylic acid such as QUINA®, poly(trimethylene terephthalate) as disclosed in U.S. Pat. No. 6,232,400 by Harris et al., and SURLYN®. LYCRA®, HYTREL®, DACRON®, KEVLAR®, ARAMID®, ORLON®, QUINA®, and SURLYN® are commercially available from E.I. DuPont de Nemours & Co. SPECTRA® from the Honeywell Co. can also be used. Suitable glass filament materials include, but are not limited to, S-GLASS® from Corning Corporation. Suitable metal filament materials include, but are not limited to, those formed of shape memory alloys ("SMA"). Examples of SMA materials include, but are not limited to, Ag—Cd, Cu—Al—Ni, Cu—Sn, Cu—Zn, Cu—Z—X (X=Si, Sn, Al), In—Ti, Ni—Al, Ni—Ti, Fe—Pt, Mn—Cu, and Fe—Mn—Si. The filament material can include at least some fibers formed of a SMA, can include fibers that are all SMA, can include fibers that include some or all non-shape memory alloy materials, or the filament material can include a blend of SMA fibers and non-SMA fibers. For example, the filament material can include a Ni—Ti SMA fiber along with non-SMA fiber, such as carbon/epoxy fiber, to provide enhanced tensile strength in comparison to composites with only non-SMA fiber.

Composite materials are further disclosed, for example, in U.S. Pat. No. 6,899,642, the entire disclosure of which is hereby incorporated herein by reference.

Also suitable for forming the intermediate core layer(s) are the composite materials disclosed in U.S. Pat. No. 6,629,898, the entire disclosure of which is hereby incorporated herein by reference.

Suitable inorganic/organic hybrid compositions include, but are not limited to, glass ionomers, resin-modified glass ionomers, fatty acid-modified glass ionomers, ormocers, inorganic-organic materials, silicon ionomers, dental cements or restorative compositions, polymerizable cements, ionomer cements, metal-oxide polymer composites, ionomer cements, aluminofluorosilicate glasses, fluoroaluminosilicate glass powders, polyalkenoate cements, flexible composites, and blends thereof. Inorganic/organic hybrid compositions are further disclosed, for example, in U.S. Pat. Nos. 6,793,592, 7,037,965, and 7,238,122, the entire disclosures of which are hereby incorporated herein by reference.

Also suitable for forming the intermediate core layer(s) are compositions comprising a plurality of susceptors which improve adhesion between layers when exposed to induction heating. The susceptors are preferably metals, more preferably magnetic and most preferably ferromagnetic materials. Suitable susceptors include iron, iron-containing compounds, cobalt nickel, strontium, gadolinium, $SrFe_{12}O_{19}$, $Co_2Ba_2Fe_{12}O_{22}$, $Fe_3O_4$ (44 micron), $Fe_3O_4$ (840 micron), $Fe_2O_3$, iron base steel stocks (e.g. S45C, and S55C) and prehardened steel stocks (e.g. NAK steel). The composition comprising susceptors may further comprise non-magnetic fillers, fibers, flakes, filaments, metal, ceramic, graphite, glass, boron, or Kevlar. The susceptors can be in the form of a continuous polygonal mesh, such as triangle, square, pentagon, hexagon, and quadrilateral. In addition, the susceptors can be in the form of discrete fillers, short fibers, long fibers, flakes, spheres, microparticles, nanoparticles, nanotubules, or nanocapsules. In one embodiment, the susceptors are mixed with a thermoplastic polymeric matrix, or a thermosetting polymeric matrix. The mixture can be applied to at least one surface of the adjacent layers before induction heating is applied. In another embodiment, the susceptors are added to a castable layer, such as polyurea, polyurethane or a staged resin film or material, before induction heating is applied to cure the castable layer. Furthermore, the susceptors can be added to a layer adjacent to the castable layer before induction heating is applied to indirectly cure the castable layer. In another embodiment, the intermediate core includes at least one thermoplastic layer containing a heat-reactive material and susceptors. The heat-reactive material reacts with itself or with the thermoplastic layer upon the induction heating. Alternatively, a moisture vapor barrier layer, as discussed further below, containing susceptors is formed between the cover and the core, and is cured by induction heating. Susceptors can also form a portion of a thin dense layer of a perimeter-weighted golf ball, as discussed further below. Compositions comprising a plurality of susceptors are further disclosed, for example, in U.S. Pat. No. 7,377,863, the entire disclosure of which is hereby incorporated herein by reference.

Alternatively, the intermediate core includes at least one layer formed from a ceramic. Suitable ceramics include, but are not limited to, silica, soda lime, lead silicate, borosilicate, aluminoborosilicate, aluminosilicate, and various glass ceramics. Also suitable are ceramic matrix composite materials including, for example, various ceramics (e.g., aluminum oxide) that are reinforced with silicon carbide fibers or whiskers. Also suitable are ceramic composites with multidirectional continuous ceramic fibers dispersed therein. Suitable ceramic materials are further disclosed, for example, in U.S. Pat. No. 6,142,887, the entire disclosure of which is hereby incorporated herein by reference.

In addition to the layer formed from a metallic, composite, or inorganic/organic hybrid composition, the intermediate core may include a layer formed from a thermoset or thermoplastic polymer composition selected from those disclosed above for forming the inner core layer(s).

In a particular embodiment, the intermediate core comprises a first intermediate core layer formed from a metallic, composite, or inorganic/organic hybrid composition and an additional intermediate core layer disposed about the first intermediate core layer, wherein the additional intermediate core layer is formed from a composition selected from thermosetting compositions other than those based on a diene rubber. In a particular aspect of this embodiment, the non-diene thermosetting composition is selected from polyurethanes, polyureas, urethane ionomers, urea ionomers, epoxies, polyamides, polyesters, polyurethane acrylates, polyurea acrylates, epoxy acrylates, silicones, polyimides, and blends and copolymers of two or more thereof. Thermosetting polyurethanes, polyureas, and blends and copolymers of two or more thereof are particularly preferred. The non-diene thermosetting composition is preferably castable or reaction injection moldable. Such compositions may prevent melting and flowing or "leaking" out at the mold equator, as a thermoset outer core layer is molded thereon at a temperature necessary to crosslink the outer core layer, which is typically from 280° F. to 360° F. for a period of about 5 to 30 minutes.

The intermediate core is enclosed with an outer core, which is single-, dual-, or multi-layered, and preferably has an overall thickness within a range having a lower limit of 0.005 or 0.010 or 0.020 or 0.025 or 0.030 or 0.035 inches and an upper limit of 0.035 or 0.040 or 0.045 or 0.060 or 0.070 or 0.075 or 0.080 or 0.100 or 0.150 inches. In a particular embodiment, the outer core has an overall thickness of 0.035 inches or 0.040 inches or 0.045 inches or 0.050 inches or 0.055 inches or 0.060 inches or 0.065 inches.

The outer core has an outer surface hardness of 25 Shore C or greater, or 45 Shore C or greater, or 50 Shore C or greater, or 70 Shore C or greater, or 75 Shore C or greater, or 80 Shore C or greater, or an outer surface hardness within a range having a lower limit of 20 or 25 or 30 or 35 or 40 or 45 or 50 or 55 or 60 or 70 or 80 or 82 or 85 Shore C and an upper limit of 60 or 70 or 75 or 80 or 90 or 92 or 93 or 95 Shore C, wherein the upper limit is greater than the lower limit (e.g., when the lower limit is 70, the upper limit is 75, 80, 90, 92, 93, or 95). The outer core layer preferably has a Shore D outer surface hardness within a range having a lower limit of 40 or 45 or 50 or 53 or 55 or 57 or 58 and an upper limit of 60 or 62 or 64 or 65 or 66 or 70. In a particular embodiment, the outer surface hardness of the outer core is greater than the outer surface hardness of the inner core. In another particular embodiment, the outer core is a single layer having a surface hardness within a range having a lower limit of 20 or 25 or 30 or 35 or 40 or 50 Shore C and an upper limit of 60 or 70 or 80 Shore C, and is formed from a rubber composition selected from those disclosed in U.S. Pat. Nos. 7,537,530 and 7,537,529, the entire disclosures of which are hereby incorporated herein by reference.

Each of the outer core layer(s) is formed from a thermoset or thermoplastic polymer composition selected from those disclosed above for forming the inner core layer(s). In a particular embodiment, the outer core consists of a single layer formed from a thermoset composition, preferably a diene rubber. In another particular embodiment, the outer core consists of a single layer formed from a thermoplastic composition. In another particular embodiment, the outer core consists of a first outer core layer and a second outer core layer, each of which is formed from the same or different thermoset compositions. In a particular aspect of this embodiment, the first outer core layer and the second outer core layer are formed from the same or different diene rubber compositions. In another particular aspect of this embodiment the first outer core layer is formed from a non-diene thermoset composition selected from those disclosed above for forming intermediate core layer(s) and the second outer core layer is formed from a diene rubber composition. In another particular embodiment, the outer core consists of a first outer core layer and a second outer core layer, each of which is formed from the same or different thermoplastic polymer compositions. In another particular embodiment, the outer core consists of a first outer core layer and a second outer core layer, wherein either the first outer core layer or the second outer core layer is formed from a thermoset composition and the other of the first outer core layer or the second outer core layer is formed from a thermoplastic polymer composition. In yet another particular embodiment, the outer core consists of a first outer core layer, a second outer core layer, and a third outer core layer, wherein each of the outer core layer compositions is the same or different than the other outer core layer compositions.

Each of the outer core layer(s) may be the same or a different composition than the composition(s) used to form the inner core layer(s). Either of the inner core layer(s) or outer core layer(s) may further comprise from 1 to 100 phr of a stiffening agent. Preferably, if present, the stiffening agent is present in an outer core layer composition. Suitable stiffening agents include, but are not limited to, ionomers, acid copolymers and terpolymers, polyamides, and polyesters. Stiffening agents are further disclosed, for example, in U.S. Pat. Nos. 6,120,390 and 6,284,840, the entire disclosures of which are hereby incorporated herein by reference. A transpolyisoprene (e.g., TP-301 transpolyisoprene, commercially available from Kuraray Co., Ltd.) or transbutadiene rubber may also be added to increase stiffness to a core layer and/or improve cold-forming properties, which may improve processability by making it easier to mold outer core layer half-shells during the golf ball manufacturing process. When included in a core layer composition, the stiffening agent is preferably present in an amount of from 5 to 10 pph.

Each of the core layers has a specific gravity within a range having a lower limit of 0.50 or 0.90 or 0.95 or 0.99 or 1.00 or 1.05 or 1.10 g/cc and an upper limit of 1.18 or 1.25 or 1.30 or 1.40 or 1.50 or 5.00 g/cc, or a specific gravity of 1.25 g/cc or less, or 1.20 g/cc or less, or 1.18 g/cc or less, or 1.15 g/cc or less. In one embodiment, the intermediate core and the outer core are each single layers and the specific gravity of the outer core layer is the same as, substantially the same as, or greater than the specific gravity of the intermediate core layer. In a particular aspect of this embodiment, the specific gravity of the outer core layer is greater than that of the inner core layer, and the outer core layer is formed from a thin dense layer composition. Thin dense layer compositions include those disclosed, for example, in U.S. Pat. No. 6,494,795, the entire disclosure of which is hereby incorporated herein by reference. Also suitable for use as thin dense layer compositions are the thermoplastic materials disclosed in U.S. Pat. Nos. 6,149,535 and 6,152,834, the entire disclosure of which is hereby incorporated herein by reference. In a particular embodiment, the outer core is a single thin dense layer, preferably having a specific gravity of 1.2 or greater, or 1.5 or greater, or 1.8 or greater, or 2 or greater, and a thickness within the range having a lower limit of 0.001 or 0.005 or 0.010 or 0.020 inches and an upper limit of 0.020 or 0.030 or 0.035 or 0.045 or 0.050 or 0.060 inches. The thin dense layer is preferably applied as a liquid solution, dispersion, lacquer, paste, gel, melt, etc., such as a loaded or filled natural or non-natural rubber latex, polyurethane, polyurea, epoxy, polyester, any reactive or non-reactive coating or casting material; and then cured, dried or evaporated down to the equilibrium solids level. The thin dense layer may also be formed by compression or injection molding, RIM, casting, spraying, dipping, powder coating, or any means of depositing materials onto the inner core. The thin dense layer may also be a thermoplastic polymer loaded with a specific gravity increasing filler, fiber, flake or particulate, such that it can be applied as a thin coating and meets the preferred specific gravity levels discussed above. One particular example of a thin dense layer, which was made from a soft polybutadiene with tungsten powder using the compression molded method, has a thickness of from 0.021 inches to 0.025 inches, a specific gravity of 1.31, and a Shore C hardness of about 72. For reactive liquid systems, the suitable materials include any material which reacts to form a solid such as epoxies, styrenated polyesters, polyurethanes or polyureas, liquid polybutadienes, silicones, silicate gels, agar gels, etc. Casting, RIM, dipping and spraying are the preferred methods of applying a reactive thin dense layer. Non-reactive materials include any combination of a polymer either in melt or flowable form, powder, dissolved or dispersed in a volatile solvent. Thin dense layers are more fully disclosed in U.S. Patent Application Publication No. 2005/0059510, the entire disclosure of which is hereby incorporated herein by reference.

The weight distribution of cores disclosed herein can be varied to achieve certain desired parameters, such as spin rate, compression, and initial velocity.

Golf ball cores of the present invention typically have a coefficient of restitution at 125 ft/s ("COR") of 0.750 or greater, or 0.775 or greater, or 0.780 or greater, or 0.782 or greater, or 0.785 or greater, or 0.787 or greater, or 0.790 or greater, or 0.795 or greater, or 0.798 or greater, or 0.800 or greater, or 0.810 or greater, or 0.820 or greater, or 0.830 or greater, or 0.840 or greater, or 0.850 or greater.

Golf ball cores of the present invention typically have an overall core compression within a range having a lower limit of 40 or 60 or 70 or 80 or 85 or 90 and an upper limit of 100 or 105 or 110 or 115.

The multi-layer core disclosed herein comprises an inner core, an intermediate core, and an outer core, wherein each of the inner core, intermediate core, and outer core may be single-, dual-, or multi-layered. Thus, a variety of core constructions are contemplated, including but not limited to the following particular constructions, each of which is represented as innermost core layer/ . . . /outermost core layer (" . . . " being the intermediate layer(s) between the innermost and outermost core layers):

TS/M/TS,
TS/TP/M/TS,
TS/TP/M/TP/TS,
TS/M/TP/TS,
TP/M/TP/TS,
TP/M/TP,
TP/TS/M/TP,
TP/M/TS/TP, and
TP/TS/M/TS/TP, wherein TS=thermoset composition; M=metallic, composite, or inorganic/organic hybrid composition; and TP=thermoplastic composition; and wherein embodiments comprising more than one TS layer and/or more than one TP layer, the TS (or TP) composition of one layer may be the same as or a different TS (or TP) composition than another layer.

The multi-layer core is enclosed with a cover, which may be a single-, dual-, or multi-layer cover preferably having an overall thickness within a range having a lower limit of 0.010 or 0.015 or 0.020 or 0.025 or 0.030 or 0.040 or 0.045 inches and an upper limit of 0.030 or 0.040 or 0.045 or 0.050 or 0.055 or 0.060 or 0.070 or 0.075 or 0.080 or 0.090 or 0.100 or 0.120 or 0.140 or 0.150 or 0.200 or 0.300 or 0.500 inches, where the upper limit is greater than the lower limit (e.g., when the lower limit is 0.040, the upper limit is 0.045, 0.050, 0.055, 0.060, 0.070, 0.075, 0.080, 0.090, 0.100, 0.120, 0.140, 0.150, 0.200, 0.300, or 0.500).

In a particular embodiment, the cover is a single layer having a thickness within a range having a lower limit of 0.010 or 0.015 or 0.020 or 0.025 or 0.027 or 0.029 or 0.030 inches and an upper limit of 0.030 or 0.033 or 0.034 or 0.035 or 0.040 or 0.050 inches, and an outer surface hardness within a range having a lower limit of 20 or 30 or 35 or 40 or 45 or 50 or 52 or 55 or 58 Shore D and an upper limit of 55 or 58 or 60 or 65 or 70 Shore D, wherein the upper limit is greater than the lower limit (e.g., when the lower limit is 58 Shore D, the upper limit is 60 or 65 or 70 Shore D).

The cover is preferably a single layer formed from a composition having a material hardness within a range having a lower limit of 30 or 35 or 40 or 45 or 50 or 52 or 55 or 58 Shore D and an upper limit of 55 or 58 or 60 or 65 Shore D, wherein the upper limit is greater than the lower limit (e.g., when the lower limit is 58 Shore D, the upper limit is 60 or 65 Shore D). The cover layer composition preferably has a flexural modulus, as measured according to ASTM D6272-98 Procedure B, within a range having a lower limit of 5,000 or 12,000 psi and an upper limit of 24,000 or 50,000 psi.

In another particular embodiment, the cover is a dual- or multi-layer cover including an inner or intermediate cover layer formed from an ionomeric composition and an outer cover layer formed from a polyurethane- or polyurea-based composition. The ionomeric layer preferably has a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer is preferably formed from a castable or reaction injection moldable polyurethane, polyurea, or copolymer or hybrid of polyurethane/polyurea. Such cover material is preferably thermosetting, but may be thermoplastic. In a particular aspect of this embodiment, the outer cover layer composition has a material hardness of 85 Shore C or less, or 45 Shore D or less, or 40 Shore D or less, or from 25 Shore D to 40 Shore D, or from 30 Shore D to 40 Shore D. In another particular aspect of this embodiment, the outer cover layer has a surface hardness within a range having a lower limit of 20 or 30 or 35 or 40 Shore D and an upper limit of 52 or 58 or 60 or 65 or 70 or 72 or 75 Shore D. In another particular aspect of this embodiment, the outer cover layer has a thickness within a range having a lower limit of 0.010 or 0.015 or 0.025 inches and an upper limit of 0.035 or 0.040 or 0.045 or 0.050 or 0.055 or 0.075 or 0.080 or 0.115 inches.

Suitable cover materials include, but are not limited to, polyurethanes, polyureas, and hybrids of polyurethane and polyurea; ionomer resins and blends thereof (e.g., Surlyn® ionomer resins and DuPont® HPF 1000 and HPF 2000, commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; and Clarix® ionomer resins, commercially available from A. Schulman Inc.); polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E. I. du Pont de Nemours and Company; polyurethane-based thermoplastic elastomers, such as Elastollan®, commercially available from BASF; synthetic or natural vulcanized rubber; and combinations thereof.

Polyurethanes, polyureas, and polyurethane-polyurea hybrids (i.e., blends and copolymers of polyurethanes and polyureas) are particularly suitable for forming cover layers of the present invention. When used as cover layer materials, polyurethanes and polyureas can be thermoset or thermoplastic. Thermoset materials can be formed into golf ball layers by conventional casting or reaction injection molding techniques. Thermoplastic materials can be formed into golf ball layers by conventional compression or injection molding techniques.

Polyurethane cover compositions of the present invention include those formed from the reaction product of at least one polyisocyanate and at least one curing agent. The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, i.e., as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy] ethoxy} benzene; 1,4-butanediol; 1,5-pentanediol; 1,6-hexanediol; resorcinol-di-(β-hydroxyethyl) ether; hydroquinone-di-(β-hydroxyethyl) ether; trimethylol propane; and combinations thereof.

Suitable polyurethane cover compositions of the present invention also include those formed from the reaction product of at least one isocyanate and at least one curing agent or the reaction produce of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, in-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p, p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); and combinations thereof.

The present invention is not limited by the use of a particular polyisocyanate in the cover composition. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("$H_{12}$MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The at least one polyisocyanate should have less than 14% unreacted NCO groups. Preferably, the at least one polyisocyanate has no greater than 8.5% NCO, more preferably from 2.5% to 8.0%, even more preferably from 4.0% to 7.2%, and most preferably from 5.0% to 6.5%.

The present invention is not limited by the use of a particular polyol in the cover composition. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol of the present invention includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); in-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2', 3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent of the present invention includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy) benzene; 1,3-bis-[2-(2-hydroxyethoxy) ethoxy] benzene; 1,3-bis-{2-[2-(2-hydroxyethoxy) ethoxy] ethoxy} benzene; 1,4-butanediol; 1,5-pentanediol; 1,6-hexanediol; resorcinol-di-(4-hydroxyethyl) ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent of the present invention. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a prepolymer method. In this method, the polyisocyanate and the polyol are mixed separately prior to addition of the curing agent. This method affords a more homogeneous mixture resulting in a more consistent polymer composition.

Suitable polyurethanes are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyureas are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea cover materials include polyurethane/polyurea blends and copolymers comprising urethane and urea segments, as disclosed in U.S. Patent Application Publication No. 2007/0117923, the entire disclosure of which is hereby incorporated herein by reference.

Compositions comprising an ionomer or a blend of two or more ionomers are also particularly suitable for forming cover layers. Preferred ionomeric cover compositions include:

(a) a composition comprising a "high acid ionomer" (i.e., having an acid content of greater than 16 wt %), such as Surlyn 8150®;

(b) a composition comprising a high acid ionomer and a maleic anhydride-grafted non-ionomeric polymer (e.g., Fusabond® functionalized polymers). A particularly preferred blend of high acid ionomer and maleic anhydride-grafted polymer is a 84 wt %/16 wt % blend of Surlyn 8150® and Fusabond®. Blends of high acid ionomers with maleic anhydride-grafted polymers are further disclosed, for example, in U.S. Pat. Nos. 6,992,135 and 6,677,401, the entire disclosures of which are hereby incorporated herein by reference;

(c) a composition comprising a 50/45/5 blend of Surlyn® 8940/Surlyn® 9650/Nucrel® 960, preferably having a material hardness of from 80 to 85 Shore C;

(d) a composition comprising a 50/25/25 blend of Surlyn® 8940/Surlyn® 9650/Surlyn® 9910, preferably having a material hardness of about 90 Shore C;

(e) a composition comprising a 50/50 blend of Surlyn® 8940/Surlyn® 9650, preferably having a material hardness of about 86 Shore C;

(f) a composition comprising a blend of Surlyn® 7940/Surlyn® 8940, optionally including a melt flow modifier;

(g) a composition comprising a blend of a first high acid ionomer and a second high acid ionomer, wherein the first high acid ionomer is neutralized with a different cation than the second high acid ionomer (e.g., 50/50 blend of Surlyn® 8150 and Surlyn® 9150), optionally including one or more melt flow modifiers such as an ionomer, ethylene-acid copolymer or ester terpolymer; and (h) a composition comprising a blend of a first high acid ionomer and a second high acid ionomer, wherein the first high acid ionomer is neutralized with a different cation than the second high acid ionomer, and from 0 to 10 wt % of an ethylene/acid/ester ionomer wherein the ethylene/acid/ester ionomer is neutralized with the same cation as either the first high acid ionomer or the second high acid ionomer or a different cation than the first and second high acid ionomers (e.g., a blend of 40-50 wt % Surlyn® 8140, 40-50 wt % Surlyn® 9120, and 0-10 wt % Surlyn® 6320).

Surlyn 8150°, Surlyn® 8940, and Surlyn® 8140 are different grades of E/MAA copolymer in which the acid groups have been partially neutralized with sodium ions. Surlyn® 9650, Surlyn® 9910, Surlyn® 9150, and Surlyn® 9120 are different grades of E/MAA copolymer in which the acid groups have been partially neutralized with zinc ions. Surlyn® 7940 is an E/MAA copolymer in which the acid groups have been partially neutralized with lithium ions. Surlyn® 6320 is a very low modulus magnesium ionomer with a medium acid content. Nucrel® 960 is an E/MAA copolymer resin nominally made with 15 wt % methacrylic acid. Surlyn® ionomers, Fusabond® polymers, and Nucrel® copolymers are commercially available from E. I. du Pont de Nemours and Company.

Ionomeric cover compositions can be blended with non-ionic thermoplastic resins, particularly to manipulate product properties. Examples of suitable non-ionic thermoplastic resins include, but are not limited to, polyurethane, polyether-ester, poly-amide-ether, polyether-urea, thermoplastic polyether block amides (e.g., Pebax® block copolymers, commercially available from Arkema Inc.), styrene-butadiene-styrene block copolymers, styrene(ethylene-butylene)-styrene block copolymers, polyamides, polyesters, polyolefins (e.g., polyethylene, polypropylene, ethylene-propylene copolymers, polyethylene-(meth)acrylate, polyethylene-(meth)acrylic acid, functionalized polymers with maleic anhydride grafting, Fusabond® functionalized polymers commercially available from E. I. du Pont de Nemours and Company, functionalized polymers with epoxidation, elastomers (e.g., ethylene propylene diene monomer rubber, metallocene-catalyzed polyolefin) and ground powders of thermoset elastomers.

Ionomer golf ball cover compositions may include a flow modifier, such as, but not limited to, Nucrel® acid copolymer resins, and particularly Nucrel® 960. Nucrel® acid copolymer resins are commercially available from E. I. du Pont de Nemours and Company.

Suitable ionomeric cover materials are further disclosed, for example, in U.S. Pat. Nos. 6,653,382, 6,756,436, 6,894,098, 6,919,393, and 6,953,820, the entire disclosures of which are hereby incorporated by reference.

Cover compositions may include one or more filler(s), such as the fillers given above for rubber compositions of the present invention (e.g., titanium dioxide, barium sulfate, etc.), and/or additive(s), such as coloring agents, fluorescent agents, whitening agents, antioxidants, dispersants, UV absorbers, light stabilizers, plasticizers, surfactants, compatibility agents, foaming agents, reinforcing agents, release agents, and the like.

In a particular embodiment, the cover is a single layer formed from a fully aliphatic polyurea. In another particular embodiment, the cover is a single layer formed from a polyurea composition, preferably selected from those disclosed in U.S. Patent Application Publication No. 2009/0011868, the entire disclosure of which is hereby incorporated herein by reference.

Suitable cover materials and constructions also include, but are not limited to, those disclosed in U.S. Patent Application Publication No. 2005/0164810, U.S. Pat. Nos. 5,919,100, 6,117,025, 6,767,940, and 6,960,630, and PCT Publications WO00/23519 and WO00/29129, the entire disclosures of which are hereby incorporated herein by reference.

A moisture vapor barrier layer is optionally employed between the core and the cover. Moisture vapor barrier layers are further disclosed, for example, in U.S. Pat. Nos. 6,632,147, 6,838,028, 6,932,720, 7,004,854, and 7,182,702, and U.S. Patent Application Publication Nos. 2003/0069082, 2003/0069085, 2003/0130062, 2004/0147344, 2004/0185963, 2006/0068938, 2006/0128505 and 2007/0129172, the entire disclosures of which are hereby incorporated herein by reference.

One or more of the golf ball layers, other than the innermost and outermost layers, is optionally a non-uniform thickness layer. For purposes of the present disclosure, a "non-uniform thickness layer" refers to a layer having projections, webs, ribs, and the like, disposed thereon such that the thickness of the layer varies. The non-uniform thickness layer preferably has one or more of: a plurality of projections disposed thereon, a plurality of a longitudinal webs, a plurality of latitudinal webs, or a plurality of circumferential webs. In a particular embodiment, the non-uniform thickness layer comprises a plurality of projections disposed on the outer surface and/or inner surface thereof. The projections may be made integral with the layer or may be made separately and then attached to the layer. The projections may have any shape or profile including, but not limited to, trapezoidal, sinusoidal, dome, stepped, cylindrical, conical, truncated conical, rectangular, pyramidal with polygonal base, truncated pyramidal or polyhedronal. Suitable shapes and profiles for the inner and outer projections also include those disclosed in U.S. Pat. No. 6,293,877, the entire disclosure of which is hereby incorporated herein by reference. In another particular embodiment, the non-uniform thickness layer comprises a plurality of inner and/or outer circular webs disposed thereon. In a particular aspect of this embodiment, the presence of the webs increases the stiffness of the non-uniform thickness layer. The webs may be longitudinal webs, latitudinal webs, or circumferential webs.

Non-uniform thickness layers of golf balls of the present invention preferably have a thickness within a range having a lower limit of 0.010 or 0.015 inches to 0.100 or 0.150 inches, and preferably have a flexural modulus within a range having a lower limit of 5,000 or 10,000 psi and an upper limit of 80,000 or 90,000 psi.

Non-uniform thickness layers are further disclosed, for example, in U.S. Pat. No. 6,773,364 and U.S. Patent Application Publication No. 2008/0248898, the entire disclosures of which are hereby incorporated herein by reference.

In addition to the materials disclosed above, any of the core or cover layers may comprise one or more of the following materials: thermoplastic elastomer, thermoset elastomer, synthetic rubber, thermoplastic vulcanizate, copolymeric ionomer, terpolymeric ionomer, polycarbonate, polyolefin, polyamide, copolymeric polyamide, polyesters, polyester-amides, polyether-amides, polyvinyl alcohols, acrylonitrile-butadiene-styrene copolymers, polyarylate, polyacrylate, polyphenylene ether, impact-modified polyphenylene ether, high impact polystyrene, diallyl phthalate polymer, metallocene-catalyzed polymers, styrene-acrylonitrile (SAN), olefin-modified SAN, acrylonitrile-styrene-acrylonitrile, styrene-maleic anhydride (S/MA) polymer, styrenic copolymer, functionalized styrenic copolymer, functionalized styrenic terpolymer, styrenic terpolymer, cellulose polymer, liquid crystal polymer (LCP), ethylene-propylene-diene rubber (EPDM), ethylene-vinyl acetate copolymer (EVA), ethylene propylene rubber (EPR), ethylene vinyl acetate, polyurea, and polysiloxane. Suitable polyamides for use as an additional material in compositions disclosed herein also include resins obtained by: (1) polycondensation of (a) a dicarboxylic acid, such as oxalic acid, adipic acid, sebacic acid, terephthalic acid, isophthalic acid or 1,4-cyclohexanedicarboxylic acid, with (b) a diamine, such as ethylenediamine, tetramethylenediamine, pentamethylenediamine, hexamethylenediamine, or decamethylenediamine, 1,4-cyclohexyldiamine or m-xylylenediamine; (2) a ring-opening polymerization of cyclic lactam, such as ε-caprolactam or ω-laurolactam; (3) polycondensation of an aminocarboxylic acid, such as 6-aminocaproic acid, 9-aminononanoic acid, 11-aminoundecanoic acid or 12-aminododecanoic acid; or (4) copolymerization of a cyclic lactam with a dicarboxylic acid and a diamine. Specific examples of suitable polyamides include Nylon 6, Nylon 66, Nylon 610, Nylon 11, Nylon 12, copolymerized Nylon, Nylon MXD6, and Nylon 46.

Other preferred materials suitable for use as an additional material in golf ball compositions disclosed herein include Skypel polyester elastomers, commercially available from SK Chemicals of South Korea; Septon® diblock and triblock copolymers, commercially available from Kuraray Corporation of Kurashiki, Japan; and Kraton® diblock and triblock copolymers, commercially available from Kraton Polymers LLC of Houston, Tex.

Ionomers are also well suited for blending with compositions disclosed herein. Suitable ionomeric polymers include α-olefin/unsaturated carboxylic acid copolymer- or terpolymer-type ionomeric resins. Copolymeric ionomers are obtained by neutralizing at least a portion of the carboxylic groups in a copolymer of an α-olefin and an α,β-unsaturated carboxylic acid having from 3 to 8 carbon atoms, with a metal ion. Terpolymeric ionomers are obtained by neutralizing at least a portion of the carboxylic groups in a terpolymer of an α-olefin, an α,β-unsaturated carboxylic acid having from 3 to 8 carbon atoms, and an α,β-unsaturated carboxylate having from 2 to 22 carbon atoms, with a metal ion. Examples of suitable α-olefins for copolymeric and terpolymeric ionomers include ethylene, propylene, 1-butene, and 1-hexene. Examples of suitable unsaturated carboxylic acids for copolymeric and terpolymeric ionomers include acrylic, methacrylic, ethacrylic, α-chloroacrylic, crotonic, maleic, fumaric, and itaconic acid. Copolymeric and terpolymeric ionomers include ionomers having varied acid contents and degrees of acid neutralization, neutralized by monovalent or bivalent cations as disclosed herein. Examples of commercially available ionomers suitable for blending with compositions disclosed herein include Surlyn® ionomer resins, commercially available from E. I. du Pont de Nemours and Company, and Iotek® ionomers, commercially available from ExxonMobil Chemical Company.

Silicone materials are also well suited for blending with compositions disclosed herein. Suitable silicone materials include monomers, oligomers, prepolymers, and polymers, with or without adding reinforcing filler. One type of silicone material that is suitable can incorporate at least 1 alkenyl group having at least 2 carbon atoms in their molecules. Examples of these alkenyl groups include, but are not limited to, vinyl, allyl, butenyl, pentenyl, hexenyl, and decenyl. The alkenyl functionality can be located at any location of the silicone structure, including one or both terminals of the structure. The remaining (i.e., non-alkenyl) silicon-bonded organic groups in this component are independently selected from hydrocarbon or halogenated hydrocarbon groups that contain no aliphatic unsaturation. Non-limiting examples of these include: alkyl groups, such as methyl, ethyl, propyl, butyl, pentyl, and hexyl; cycloalkyl groups, such as cyclohexyl and cycloheptyl; aryl groups, such as phenyl, tolyl, and xylyl; aralkyl groups, such as benzyl and phenethyl; and halogenated alkyl groups, such as 3,3,3-trifluoropropyl and chloromethyl. Another type of suitable silicone material is one having hydrocarbon groups that lack aliphatic unsaturation. Specific examples include: trimethylsiloxy-endblocked dimethylsiloxane-methylhexenylsiloxane copolymers; dimethylhexenylsiloxy-endblocked dimethylsiloxane-methylhexenylsiloxane copolymers; trimethylsiloxy-endblocked dimethylsiloxane-methylvinylsiloxane copolymers; trimethylsiloxyl-endblocked methylphenylsiloxane-dimethylsiloxane-methylvinysiloxane copolymers; dimethylvinylsiloxy-endblocked dimethylpolysiloxanes; dimethylvinylsiloxy-endblocked dimethylsiloxane-methylvinylsiloxane copolymers; dimethylvinylsiloxy-endblocked methylphenylpolysiloxanes; dimethylvinylsiloxy-endblocked methylphenylsiloxane-dimethylsiloxane-methylvinylsiloxane copolymers; and the copolymers listed above wherein at least one group is dimethylhydroxysiloxy. Examples of commercially available silicones suitable for blending with compositions disclosed herein include Silastic® silicone rubber, commercially available from Dow Corning Corporation of Midland, Mich.; Blensil® silicone rubber, commercially available from General Electric Company of Waterford, N.Y.; and Elastosil® silicones, commercially available from Wacker Chemie AG of Germany.

Other types of copolymers can also be added to the golf ball compositions disclosed herein. For example, suitable copolymers comprising epoxy monomers include styrene-butadiene-styrene block copolymers in which the polybutadiene block contains an epoxy group, and styrene-isoprene-styrene block copolymers in which the polyisoprene block contains epoxy. Examples of commercially available epoxy functionalized copolymers include ESBS A1005, ESBS A1010, ESBS A1020, ESBS AT018, and ESBS AT019 epoxidized styrene-butadiene-styrene block copolymers, commercially available from Daicel Chemical Industries, Ltd. of Japan.

Ionomeric compositions used to form golf ball layers of the present invention can be blended with non-ionic thermoplastic resins, particularly to manipulate product properties. Examples of suitable non-ionic thermoplastic resins include, but are not limited to, polyurethane, poly-ether-ester, poly-amide-ether, polyether-urea, Pebax® thermoplastic polyether block amides commercially available from Arkema Inc., styrene-butadiene-styrene block copolymers, styrene(ethylene-butylene)-styrene block copolymers, polyamides, polyesters, polyolefins (e.g., polyethylene, polypropylene, ethylene-propylene copolymers, ethylene-(meth) acrylate, ethylene-(meth)acrylic acid, functionalized polymers with maleic anhydride grafting, epoxidation, etc., elastomers (e.g., EPDM, metallocene-catalyzed polyethylene) and ground powders of the thermoset elastomers.

Compositions disclosed herein can be either foamed or filled with density adjusting materials to provide desirable golf ball performance characteristics.

The present invention is not limited by any particular process for forming the golf ball layer(s). It should be understood that the layer(s) can be formed by any suitable technique, including injection molding, compression molding, casting, and reaction injection molding. In particular, a thin thermosetting layer may be formed by any conventional means for forming a thin layer of vulcanized or otherwise crosslinked rubber including, but not limited to, compression molding, rubber-injection molding, casting of a liquid rubber, and laminating.

When injection molding is used, the composition is typically in a pelletized or granulated form that can be easily fed into the throat of an injection molding machine wherein it is melted and conveyed via a screw in a heated barrel at temperatures of from 150° F. to 600° F., preferably from 200° F. to 500° F. The molten composition is ultimately injected into a closed mold cavity, which may be cooled, at ambient or at an elevated temperature, but typically the mold is cooled to a temperature of from 50° F. to 70° F. After residing in the closed mold for a time of from 1 second to 300 seconds, preferably from 20 seconds to 120 seconds, the core and/or core plus one or more additional core or cover layers is removed from the mold and either allowed to cool at ambient or reduced temperatures or is placed in a cooling fluid such as water, ice water, dry ice in a solvent, or the like.

When compression molding is used to form a core, the composition is first formed into a preform or slug of material, typically in a cylindrical or roughly spherical shape at a weight slightly greater than the desired weight of the molded core. Prior to this step, the composition may be first extruded or otherwise melted and forced through a die after which it is cut into a cylindrical preform. The preform is then placed into a compression mold cavity and compressed at a mold temperature of from 150° F. to 400° F., preferably from 250° F. to 400° F., and more preferably from 300° F. to 400° F. When compression molding an outer layer, half-shells of the layer material are first formed via injection molding. A golf ball subassembly is then enclosed within two half-shells, which is then placed into a compression mold cavity and compressed.

Reaction injection molding processes are further disclosed, for example, in U.S. Pat. Nos. 6,083,119, 7,208,562, 7,281,997, 7,282,169, 7,338,391, and U.S. Patent Application Publication No. 2006/0247073, the entire disclosures of which are hereby incorporated herein by reference.

Thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

Golf balls of the present invention typically have a COR of 0.700 or greater, preferably 0.750 or greater, and more preferably 0.780 or greater. COR, as used herein, is determined according to a known procedure wherein a golf ball or golf ball subassembly (e.g., a golf ball core) is fired from an air cannon at two given velocities and calculated at a velocity of 125 ft/s. Ballistic light screens are located between the air cannon and the steel plate at a fixed distance to measure ball velocity. As the ball travels toward the steel plate, it activates each light screen, and the time at each light screen is measured. This provides an incoming transit time period inversely proportional to the ball's incoming velocity. The ball impacts the steel plate and rebounds though the light screens, which again measure the time period required to transit between the light screens. This provides an outgoing transit time period inversely proportional to the ball's outgoing velocity. COR is then calculated as the ratio of the outgoing transit time period to the incoming transit time period, $COR=V_{out}/V_{in}=T_{in}/T_{out}$.

Golf balls of the present invention typically have a compression of 40 or greater, or a compression within a range having a lower limit of 40 or 50 or 60 or 65 or 80 or 85 or 90 and an upper limit of 80 or 85 or 90 or 100 or 110 or 115 or 120, where the upper limit is greater than the lower limit (e.g., when the lower limit is 85, the upper limit is 90, 100, 110, 115, or 120). Compression is an important factor in golf ball design. For example, the compression of the core can affect the ball's spin rate off the driver and the feel. As disclosed in Jeff Dalton's *Compression by Any Other Name, Science and Golf IV, Proceedings of the World Scientific Congress of Golf* (Eric Thain ed., Routledge, 2002) ("J. Dalton"), several different methods can be used to measure compression, including Atti compression, Riehle compression, load/deflection measurements at a variety of fixed loads and offsets, and effective modulus. For purposes of the present invention, "compression" refers to Atti compression and is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Very low stiffness cores will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

Golf balls of the present invention typically have dimple coverage of 60% or greater, preferably 65% or greater, and more preferably 75% or greater.

Golf balls of the present invention can have an overall diameter of any size. The preferred diameter of the present golf balls is within a range having a lower limit of 1.680 inches and an upper limit of 1.740 or 1.760 or 1.780 or 1.800 inches.

Golf balls of the present invention preferably have a moment of inertia ("MOI") of 70-95 $g \cdot cm^2$, preferably 75-93 $g \cdot cm^2$, and more preferably 76-90 $g \cdot cm^2$. For low MOI embodiments, the golf ball preferably has an MOI of 85 $g \cdot cm^2$ or less, or 83 $g \cdot cm^2$ or less. For high MOI embodiment, the golf ball preferably has an MOI of 86 $g \cdot cm^2$ or greater, or 87 $g \cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

The surface hardness of a golf ball layer is obtained from the average of a number of measurements taken from opposing hemispheres, taking care to avoid making measurements on the parting line of the core or on surface defects, such as holes or protrusions. Hardness measurements are made pursuant to ASTM D-2240 "Indentation Hardness of Rubber and Plastic by Means of a Durometer." Because of the curved surface, care must be taken to insure that the golf ball or golf ball subassembly is centered under the durometer indentor before a surface hardness reading is obtained. A calibrated, digital durometer, capable of reading to 0.1 hardness units is used for all hardness measurements and is set to take hardness readings at 1 second after the maximum reading is obtained. The digital durometer must be attached to, and its foot made parallel to, the base of an automatic stand. The weight on the durometer and attack rate conform to ASTM D-2240.

The center hardness of a core is obtained according to the following procedure. The core is gently pressed into a hemispherical holder having an internal diameter approximately slightly smaller than the diameter of the core, such that the core is held in place in the hemispherical portion of the holder while concurrently leaving the geometric central plane of the core exposed. The core is secured in the holder by friction, such that it will not move during the cutting and grinding steps, but the friction is not so excessive that distortion of the natural shape of the core would result. The core is secured such that the parting line of the core is roughly parallel to the top of the holder. The diameter of the core is measured 90 degrees to this orientation prior to securing. A measurement is also made from the bottom of the holder to the top of the core to provide a reference point for future calculations. A rough cut is made slightly above the exposed geometric center of the core using a band saw or other appropriate cutting tool, making sure that the core does not move in the holder during this step. The remainder of the core, still in the holder, is secured to the base plate of a surface grinding machine. The exposed 'rough' surface is ground to a smooth, flat surface, revealing the geometric center of the core, which can be verified by measuring the height from the bottom of the holder to the exposed surface of the core, making sure that exactly half of the original height of the core, as measured above, has been removed to within ±0.004 inches. Leaving the core in the holder, the center of the core is found with a center square and carefully marked and the hardness is measured at the center mark according to ASTM D-2240. Additional hardness measurements at any distance from the center of the core can then be made by drawing a line radially outward from the center mark, and measuring the hardness at any given distance along the line, typically in 2 mm increments from the center. The hardness at a particular distance from the center should be measured along at least two, preferably four, radial arms located 180° apart, or 90° apart, respectively, and then averaged. All hardness measurements performed on a plane passing through the geometric center are performed while the core is still in the holder and without having disturbed its orientation, such that the test surface is constantly parallel to the bottom of the holder, and thus also parallel to the properly aligned foot of the durometer.

Hardness points should only be measured once at any particular geometric location.

For purposes of the present disclosure, a hardness gradient of a center is defined by hardness measurements made at the outer surface of the center and the center point of the core. "Negative" and "positive" refer to the result of subtracting the hardness value at the innermost portion of the golf ball component from the hardness value at the outer surface of the component. For example, if the outer surface of a solid center has a lower hardness value than the center (i.e., the surface is softer than the center), the hardness gradient will be deemed a "negative" gradient. In measuring the hardness gradient of a center, the center hardness is first determined according to the procedure above for obtaining the center hardness of a core. Once the center of the core is marked and the hardness thereof is determined, hardness measurements at any distance from the center of the core may be measured by drawing a line radially outward from the center mark, and measuring and marking the distance from the center, typically in 2 mm increments. All hardness measurements performed on a plane passing through the geometric center are performed while the core is still in the holder and without having disturbed its orientation, such that the test surface is constantly parallel to the bottom of the holder. The hardness difference from any predetermined location on the core is calculated as the average surface hardness minus the hardness at the appropriate reference point, e.g., at the center of the core for a single, solid core, such that a core surface softer than its center will have a negative hardness gradient.

Hardness gradients are disclosed more fully, for example, in U.S. Pat. No. 7,429,221, and U.S. patent application Ser. No. 11/939,632, filed on Nov. 14, 2007; Ser. No. 11/939,634, filed on Nov. 14, 2007; Ser. No. 11/939,635, filed on Nov. 14, 2007; and Ser. No. 11/939,637, filed on Nov. 14, 2007; the entire disclosure of each of these references is hereby incorporated herein by reference.

It should be understood that there is a fundamental difference between "material hardness" and "hardness as measured directly on a golf ball." For purposes of the present disclosure, material hardness is measured according to ASTM D2240 and generally involves measuring the hardness of a flat "slab" or "button" formed of the material. Hardness as measured directly on a golf ball (or other spherical surface) typically results in a different hardness value. This difference in hardness values is due to several factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains. For example, it is also envisioned that a layer of composite composition comprising functionalized nanostructures may in some embodiments be suitable as any intermediate golf ball layer such as a casing layer or inner cover layer.

What is claimed is:

1. A golf ball comprising:

an inner core comprising a center formed from a first thermoset composition, wherein the inner core has a diameter of from 0.5000 inches to 1.580 inches, a center hardness of from 40 Shore C to 70 Shore C, and a surface hardness of from 50 Shore C to 95 Shore C;

an intermediate core layer having a thickness of from 0.0010 inches to 0.070 inches and an outer surface hardness of from 65 Shore D to 95 Shore D and formed from a composite composition comprising functionalized nano-structures selected from the group consisting of functionalized graphene, functionalized carbon nanotube, functionalized polyamide nano-fiber, and combinations thereof;

an outer core layer formed from a second thermoset composition and having a thickness of from 0.010 inches to 0.075 inches and an outer surface hardness of from 45 Shore C to 90 Shore C; and a cover layer having a thickness of from 0.010 inches to 0.050 inches and formed from a composition having a material hardness of from 30 Shore D to 65 Shore D.

2. The golf ball of claim 1, wherein the functionalized nano-structures are mixed with conductive nanoshelled structures.

3. The golf ball of claim 2, wherein the conductive nanoshelled structures comprise zinc oxide nanoshells, magnesium oxide nanoshells, or combinations thereof.

4. The golf ball of claim 2, wherein the conductive nanoshelled structures have surface cations selected from the group consisting of zinc, sodium, magnesium, lithium, potassium, and combinations thereof.

5. The golf ball of claim 2, wherein the functionalized nano-structures and conductive nanoshelled structures are included in the composite composition in a ratio of 98:2 to 50:50.

6. The golf ball of claim 1, wherein the diameter of the inner core is from 1.400 inches to 1.490 inches.

7. The golf ball of claim 1, wherein the outer surface hardness of the intermediate core layer is from 75 Shore D to 95 Shore D.

8. The golf ball of claim 1, wherein the inner core comprises an additional inner core layer.

9. The golf ball of claim 1, wherein the golf ball additionally comprises a thermoplastic core layer disposed between the inner core and the intermediate core layer.

10. The golf ball of claim 1, wherein the golf ball additionally comprises a thermoplastic core layer disposed between the intermediate core layer and the outer core layer.

11. A golf ball comprising:

an inner core comprising a center formed from a first thermoset composition, wherein the inner core has a diameter of from 1.000 inches to 1.580 inches, a center hardness of from 40 Shore C to 70 Shore C, and a surface hardness of from 50 Shore C to 95 Shore C;

an intermediate core layer having a thickness of from 0.0010 inches to 0.070 inches and an outer surface hardness of from 65 Shore D to 95 Shore D and formed from a composite composition comprising functionalized nano-structures;

an outer core layer formed from a second thermoset composition and having a thickness of from 0.010 inches to 0.075 inches and an outer surface hardness of from 45 Shore C to 90 Shore C;

a first thermoplastic core layer disposed between the inner core and the intermediate core layer and a second thermoplastic core layer disposed between the intermediate core layer and the outer core layer; and a cover layer having a thickness of from 0.010 inches to 0.050 inches and formed from a composition having a material hardness of from 30 Shore D to 65 Shore D.

12. The golf ball of claim 11, wherein the nano-structures are selected from the group consisting of nanoflakes, nanofibers, nanofillers, nanotubes, nanoparticles, nanocages, and combinations thereof.

13. The golf ball of claim 11, wherein the functionalized nano-structures are selected from the group consisting of functionalized polymer nano-structures, functionalized metallic nano-structures, and functionalized elemental nano-structures.

14. The golf ball of claim 11, wherein the functionalized nano-structures comprise functionalized graphene.

15. The golf ball of claim 11, wherein the functionalized nano-structures comprise functionalized carbon nanotube.

16. The golf ball of claim 11, wherein the functionalized nano-structures comprise functionalized polyamide nano-fiber.

17. The golf ball of claim 11, wherein the functionalized nano-structures are mixed with conductive nanoshelled structures.

18. The golf ball of claim 11, wherein the diameter of the inner core is from 1.400 inches to 1.490 inches.

19. The golf ball of claim 11, wherein the outer surface hardness of the intermediate core layer is from 75 Shore D to 95 Shore D.

* * * * *